US012630959B2

(12) United States Patent
Kim et al.

(10) Patent No.: US 12,630,959 B2
(45) Date of Patent: May 19, 2026

(54) CLOTHES TREATING APPARATUS AND CLOTHES TREATING SYSTEM

(71) Applicant: SAMSUNG ELECTRONICS CO., LTD., Suwon-si (KR)

(72) Inventors: Junho Kim, Suwon-si (KR); Hyounyoung Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 130 days.

(21) Appl. No.: 18/532,462

(22) Filed: Dec. 7, 2023

(65) Prior Publication Data

US 2024/0167213 A1 May 23, 2024

Related U.S. Application Data

(63) Continuation of application No. PCT/KR2023/016816, filed on Oct. 27, 2023.

(30) Foreign Application Priority Data

Nov. 22, 2022 (KR) ..... 10-2022-0157696
Feb. 2, 2023 (KR) ..... 10-2023-0014483

(51) Int. Cl.
*D06F 34/34* (2020.01)
*D06F 34/08* (2020.01)

(52) U.S. Cl.
CPC ..... *D06F 34/34* (2020.02); *D06F 34/08* (2020.02)

(58) Field of Classification Search
None
See application file for complete search history.

(56) References Cited

U.S. PATENT DOCUMENTS 7,096,601 B2 8/2006 Lyu et al.
7,373,737 B2 5/2008 Lyu et al.
7,383,644 B2 6/2008 Lyu et al.
8,187,387 B2 * 5/2012 Kim ..... D06F 58/45 34/443
9,605,372 B2 * 3/2017 Kim ..... D06F 34/28
10,711,381 B2 7/2020 Li et al.
10,943,590 B2 3/2021 Lee
11,198,964 B2 12/2021 Son et al.
(Continued)

FOREIGN PATENT DOCUMENTS

KR 10-0495052 B1 6/2005
KR 10-0607273 B1 7/2006
(Continued)

OTHER PUBLICATIONS

KR 10-2021-0087897 translation (Year: 2021).*
(Continued)

*Primary Examiner* — Rita P Adhlakha
(74) *Attorney, Agent, or Firm* — STAAS & HALSEY LLP

(57) ABSTRACT

A clothes treating system including a first clothes treating apparatus including a first housing; a second clothes treating apparatus including a second housing; an integrated user interface device mounted on the first housing and configured to control the first clothes treating apparatus and the second clothes treating apparatus; and a separate user interface device mounted on the second housing and configured to control the second clothes treating apparatus.

15 Claims, 17 Drawing Sheets

(56) References Cited

U.S. PATENT DOCUMENTS

| | | | |
|---|---|---|---|
| 11,421,367 | B2 | 8/2022 | Kim |
| 11,560,661 | B2 | 1/2023 | Kim et al. |
| 11,828,015 | B2 | 11/2023 | Kim |
| 2008/0256984 | A1 | 10/2008 | Lim et al. |
| 2009/0025432 | A1 | 1/2009 | Kim et al. |
| 2021/0269957 | A1 | 9/2021 | Jin et al. |
| 2023/0175194 | A1 | 6/2023 | Ryoo et al. |

FOREIGN PATENT DOCUMENTS

| | | | |
|---|---|---|---|
| KR | 10-0607279 | B1 | 7/2006 |
| KR | 10-0717458 | B1 | 5/2007 |
| KR | 10-2007-0067464 | | 6/2007 |
| KR | 10-1275202 | B1 | 6/2013 |
| KR | 10-1306698 | B1 | 9/2013 |
| KR | 10-2018-0086168 | | 7/2018 |
| KR | 10-1954968 | | 3/2019 |
| KR | 10-2021-0087764 | | 7/2021 |
| KR | 10-2021-0087897 | | 7/2021 |
| KR | 10-2021-0088500 | | 7/2021 |
| KR | 10-2021-0114092 | A | 9/2021 |
| KR | 10-2446189 | | 9/2022 |

OTHER PUBLICATIONS

International Search Report dated Feb. 19, 2024 for International Application No. PCT/KR2023/016816.

Written Opinion of the International Searching Authority dated Feb. 19, 2024 for International Application No. PCT/KR2023/016816.

* cited by examiner

CLOTHES TREATING APPARATUS AND CLOTHES TREATING SYSTEM

CROSS-REFERENCE TO RELATED APPLICATIONS

This is a continuation application of International Application PCT/KR2023/016816, filed Oct. 27, 2023, which is incorporated herein by reference in its entirety, it being further noted that foreign priority benefit is based upon Korean Patent Application Nos. 10-2022-0157696, filed Nov. 22, 2022, and 10-2023-0014483, filed Feb. 2, 2023, the disclosures of which are incorporated by reference herein in their entireties.

BACKGROUND

1. Field

The disclosure relates to a clothes treating apparatus and a clothes treating system having the same.

2. Description of the Related Art

In general, a clothes treating apparatus is apparatus that treats and/or manages clothes and may include a washing machine and a dryer.

A washing machine is an apparatus that uses a driving force of a drive motor to agitate laundry, water, and detergent put into a tub so that washing is performed by mutual friction. A procedure to be performed by a washing machine, regardless of the type of washing machine, may include a washing process in which detergent and water are supplied to a tub containing laundry and the drum is rotated to wash the laundry, and a rinsing process in which water is supplied to the tub and the drum is rotated to rinse the laundry, and a spin-drying process in which water is drained from the tub and the drum is rotated to remove moisture from the laundry.

A dryer is an apparatus that dries an object with hot dry air. The dryer is designed to dry the object by allowing hot air to pass through a drum while rotating the drum in which the object is accommodated at a low speed. An operation performed by the dryer may include a drying process of drying an object.

For ease of use, a plurality of clothes treating apparatuses may be connected and used.

SUMMARY

Aspects of embodiments of the disclosure will be set forth in part in the description which follows and, in part, will be apparent from the description, or may be learned by practice of the presented embodiments.

According to an embodiment of the disclosure, a clothes treating system includes a first clothes treating apparatus including a first housing; a second clothes treating apparatus including a second housing; an integrated user interface device mounted on the first housing and configured to control the first clothes treating apparatus and the second clothes treating apparatus; and a separate user interface device mounted on the second housing and configured to control the second clothes treating apparatus.

According to an embodiment of the disclosure, the first clothes treating apparatus may include a first controller, the second clothes treating apparatus may include a second controller, the integrated user interface device may be connected to the first controller and the second controller, and the separate user interface device may be connected to the second controller.

According to an embodiment of the disclosure, the integrated user interface device may include an integrated input interface configured to receive a user input, and an integrated output interface configured to display integrated visual information associated with the first clothes treating apparatus and the second clothes treating apparatus. The separate user interface device may include a separate input interface configured to receive a user input, and a separate output interface configured to display separate visual information associated with the second clothes treating apparatus.

According to an embodiment of the disclosure, the separate user interface device may include a board cover mounted on the second housing, a circuit board connected to the board cover, and a board case configured to accommodate the circuit board, and the separate input interface and the separate output interface may be arranged on the board cover.

According to an embodiment of the disclosure, the second housing may include a front frame configured to form a front surface of the second clothes treating apparatus, and an upper cap mounted on an upper portion of the front frame to form a portion of an upper surface of the second clothes treating apparatus, and the board cover may be mounted on the upper cap.

According to an embodiment of the disclosure, the upper cap may include a cap opening in which to mount the separate user interface device. The front frame may include a frame opening corresponding to the cap opening.

According to an embodiment of the disclosure, the front frame may include a reinforcing portion formed at a portion of the front frame on which the upper cap is mounted.

According to an embodiment of the disclosure, the second clothes treating apparatus may include a sensor in the separate user interface device, the sensor being configured to detect humidity.

According to an embodiment of the disclosure, the board cover may include a cover inlet configured to allow moisture to flow into the separate user interface device in which the sensor is positioned. The board case may include a cover outlet configured to be inclined downwardly so that the moisture introduced through the cover inlet is discharged from the separate user interface device.

According to an embodiment of the disclosure, the second controller may be configured to stop an operation of the separate user interface device based on receiving a command input through the integrated input interface.

According to an embodiment of the disclosure, the integrated user interface device may be disposed on a front surface of the first clothes treating apparatus. The separate user interface device may be disposed on at least one of an upper surface, a side surface, and a front surface of the second clothes treating apparatus.

According to an embodiment of the disclosure, the second clothes treating apparatus may include a door coupled to the second housing. The separate user interface device may be disposed on the door coupled to the second housing.

According to an embodiment of the disclosure, the second clothes treating apparatus may be mounted above the first clothes treating apparatus.

According to an embodiment of the disclosure, the first clothes treating apparatus may be a washing machine. The second clothes treating apparatus may be a dryer.

According to an embodiment of the disclosure, a clothes treating apparatus includes a housing including a front frame in which an inlet is formed forward and an upper cap mounted on an upper portion of the front frame; a door configured to open and close the inlet; and a user interface device provided on an upper surface of the housing. The user interface device includes a board cover mounted on the upper cap and including an input interface and an output interface, a circuit board connected to the board cover, and a board case configured to accommodate the circuit board.

According to an embodiment of the disclosure, the second clothes treating apparatus may be configured to be positioned above or below the first clothes treating apparatus.

According to an embodiment of the disclosure, the second clothes treating apparatus may be configured to be positioned at a side of the first clothes treating apparatus.

BRIEF DESCRIPTION OF THE DRAWINGS

These and/or other embodiments of the disclosure will become apparent and more readily appreciated from the following description of embodiments, taken in conjunction with the accompanying drawings of which.

DETAILED DESCRIPTION

Figure 1:
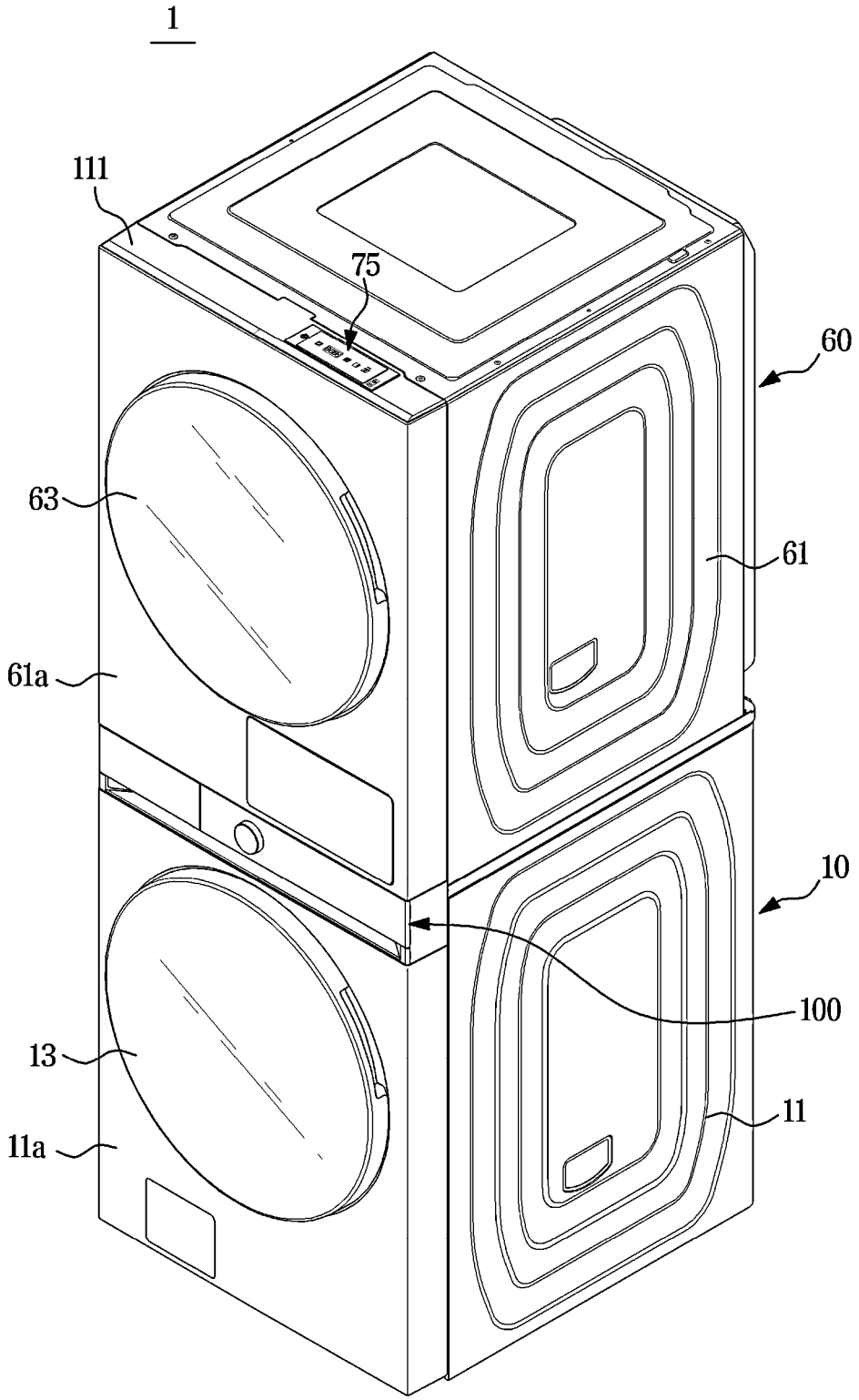
FIG. 1 is a view illustrating a clothes treating system according to an embodiment of the disclosure.

Various embodiments and terms in this document are not intended to limit the technical features described in this document to specific embodiments, and should be understood to include various modifications, equivalents, or substitutes of the embodiments.

In connection with the description of the drawings, like reference numbers may be used for like or related elements.

The singular form of a noun corresponding to an item may include one item or a plurality of items, unless the relevant context clearly dictates otherwise.

In this document, each of phrases such as "A or B," "at least one of A and B," "at least one of A or B," "A, B or C," "at least one of A, B and C," and "at least one of A, B, or C" may include any one of the items listed together in the corresponding one of the phrases, or all possible combinations thereof.

The term "and/or" includes any combination of a plurality of related components or any one of a plurality of related components.

Terms such as "first," "second," "primary," and "secondary" may simply be used to distinguish a given component from other corresponding components, and do not limit the corresponding components in any other respect (e.g., importance or order).

When any (e.g., first) component is referred to as being "coupled" or "connected" to another (e.g., second) component with or without the terms "functionally" or "communicatively", this means that the any component may be connected to the other component directly (e.g., by a wire), wirelessly, or through a third component.

The terms "comprises" and "has" are intended to indicate that there are features, numbers, steps, operations, components, parts, or combinations thereof described in this document, and do not exclude the presence or addition of one or more other features, numbers, steps, operations, components, parts, or combinations thereof.

When any component is referred to as being "connected", "coupled", "supported" or "in contact" with another component, this includes a case in which the components are indirectly connected, coupled, supported, or in contact with each other through a third component as well as directly connected, coupled, supported, or in contact with each other.

When any component is referred to as being located "on" or "over" another component, this includes not only a case in which any component is in contact with another component but also a case in which another component is present between the two components.

A washing machine according to various embodiments may perform washing, rinsing, dewatering, and drying processes. A washing machine is an example of a clothes treating apparatus, and the clothes treating apparatus is a concept encompassing an apparatus for washing clothes (objects to be washed, objects to be dried), an apparatus for drying clothes, and an apparatus capable of washing and drying clothes.

A washing machine according to various embodiments may include a top-loading washing machine in which a laundry inlet for putting in or taking out laundry is provided to face upward or a front-loading washing machine in which a laundry inlet is provided to face forward. A washing machine according to various embodiments may include a washing machine of another loading method other than a top-loading washing machine and a front-loading washing machine.

In the case of a top-loading washing machine, laundry may be washed using a water current occurred by a rotating body such as a pulsator. In the case of a front-loading washing machine, laundry may be washed by rotating a drum to repeatedly raise and drop laundry. The front-loading washing machine may include a drying combined washing machine capable of drying laundry accommodated inside a drum. The drying combined washing machine may include a hot air supply device for supplying high-temperature air into the drum and a condensing device for removing moisture from air discharged from the drum. For example, the drying combined washing machine may include a heat pump device. A washing machine according to various embodiments may include a washing machine using a washing method other than the above-described washing method.

Embodiments of the disclosure may provide a clothes treating system with improved usability. Embodiments of the disclosure are not limited to the various aspects mentioned above, and other aspects not mentioned will be clearly understood by those skilled in the art from the description below.

Hereinafter, an embodiment according to the disclosure will be described in detail with reference to the accompanying drawings.

Figure 2:
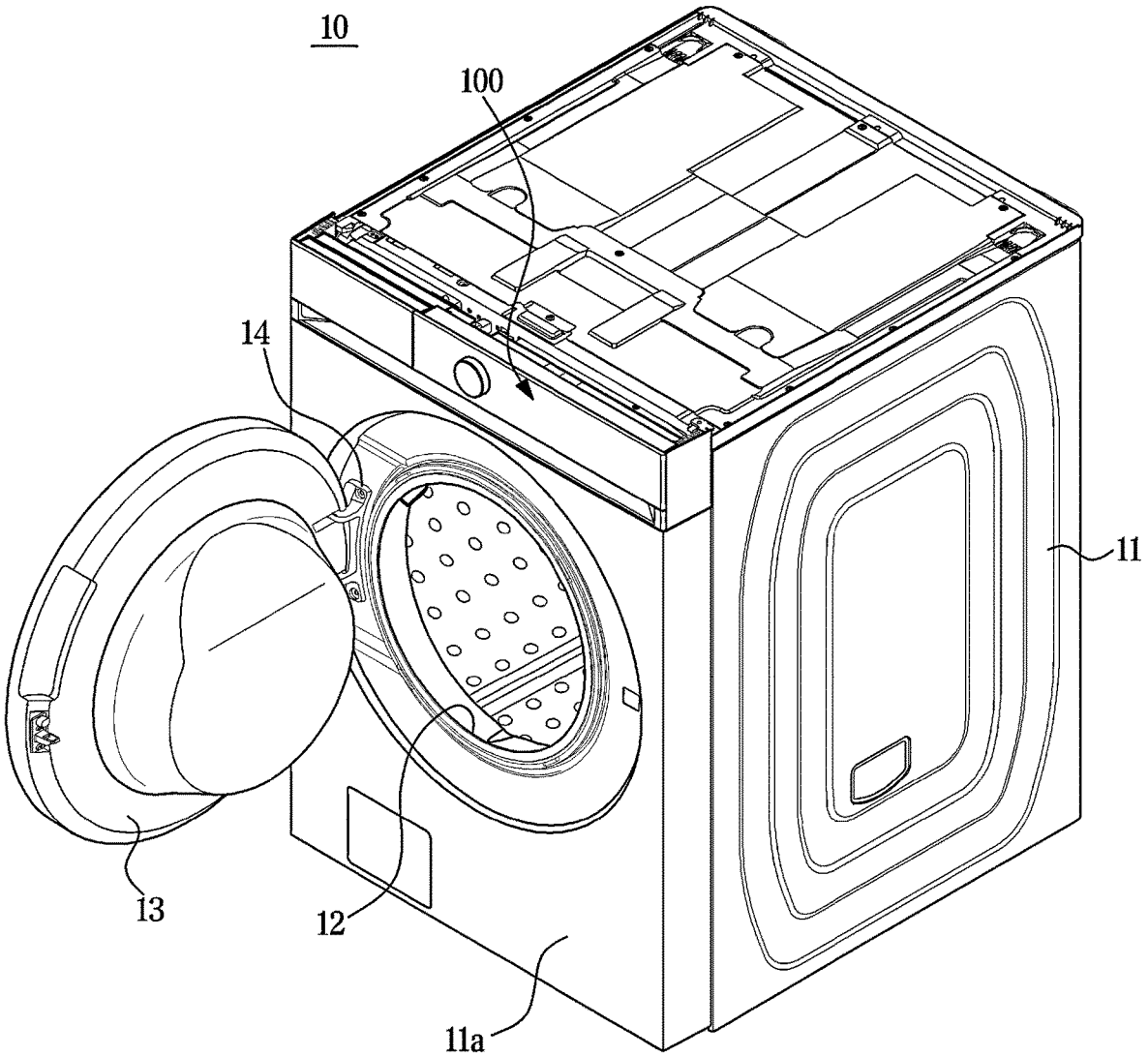
FIG. 2 is a view illustrating a first clothes treating apparatus of a clothes treating system according to an embodiment of the disclosure.
Figure 3:
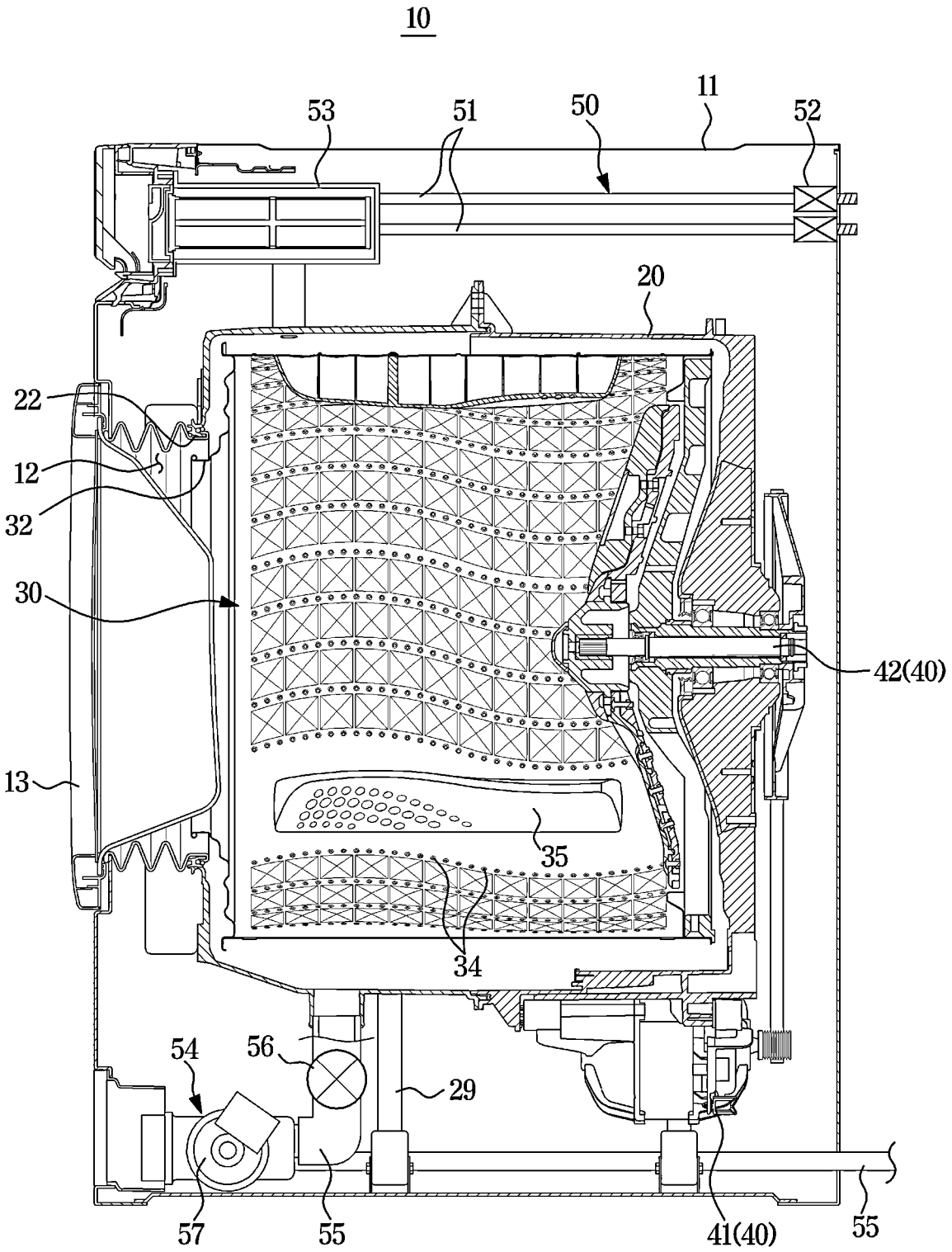
FIG. 3 is a cross-sectional view illustrating a first clothes treating apparatus of a clothes treating system according to an embodiment of the disclosure.
Figure 4:
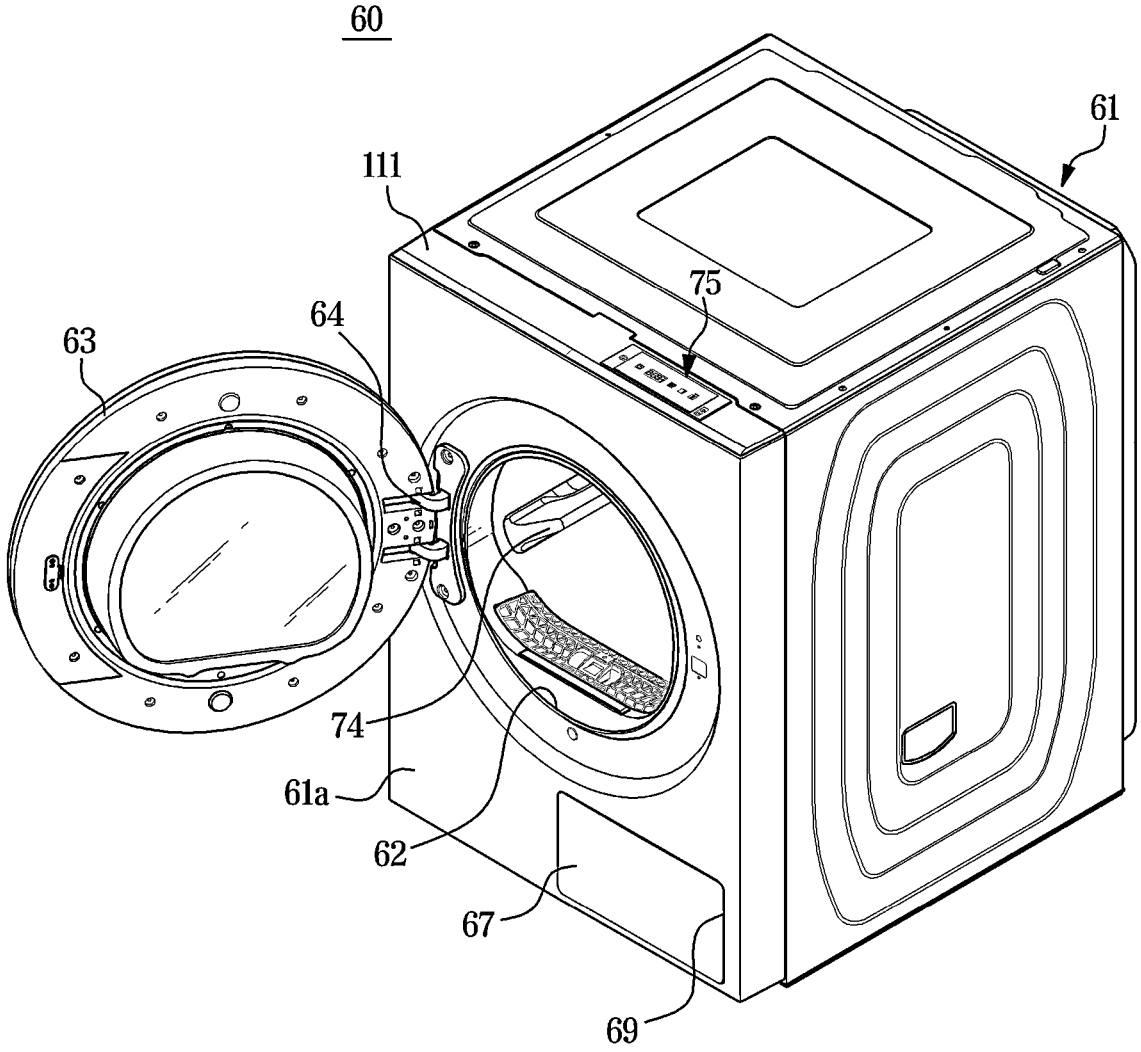
FIG. 4 is a view illustrating a second clothes treating apparatus of the clothes treating system according to an embodiment of the disclosure.
Figure 5:
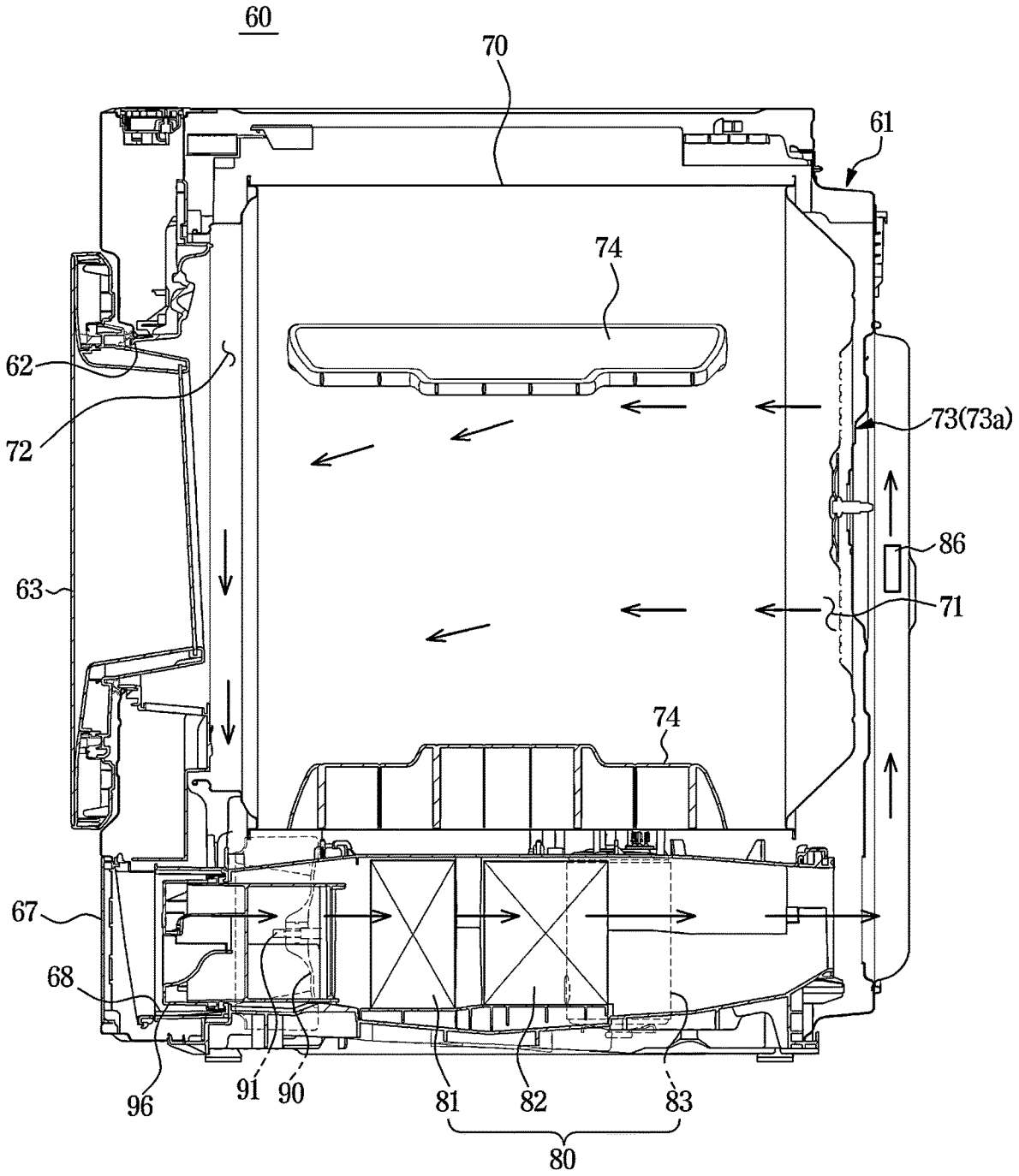
FIG. 5 is a cross-sectional view illustrating a second clothes treating apparatus of a clothes treating system according to an embodiment of the disclosure.

FIG. 1 illustrates a clothes treating system according to an embodiment. FIG. 2 illustrates a first clothes treating apparatus of a clothes treating system according to an embodiment. FIG. 3 illustrates a cross-sectional view of the first clothes treating apparatus according to an embodiment. FIG. 4 illustrates a second clothes treating apparatus of the clothes treating system according to an embodiment. FIG. 5 is a cross-sectional view of the second laundry treating apparatus according to an embodiment.

As shown in FIG. 1, a clothes treating system 1 may include a first clothes treating apparatus 10 and a second clothes treating apparatus 60 mounted on the first clothes treating apparatus 10. The second clothes treating apparatus 60 may be provided on one side of the first clothes treating apparatus 10. For example, the second clothes treating apparatus 60 may be mounted above the first clothes treating apparatus 10.

The first clothes treating apparatus 10 may be a washing machine or a dryer. For example, the first clothes treating apparatus 10 may be a washing machine.

Referring to FIG. 2 and FIG. 3, the first clothes treating apparatus 10 according to various embodiments may include a first housing 11 accommodating various components therein. The first housing 11 may be provided in the form of a box having a laundry inlet 12 formed on one side thereof.

The first clothes treating apparatus 10 may include a first front frame 11*a* forming a front surface. The laundry inlet 12 may be formed on the first front frame 11*a*.

The first clothes treating apparatus 10 may include a first door 13 provided to open and close the laundry inlet 12. The first door 13 may be rotatably mounted to the first housing 11 by a first hinge 14. At least a portion of the first door 13 may be transparent or translucent so that the inside of the first housing 11 is visible.

The first clothes treating apparatus 10 may include a tub 20 provided inside the first housing 11 to store water. The tub 20 may be provided in a substantially cylindrical shape with a tub opening 22 formed at one side thereof, and be disposed inside the first housing 11 such that the tub opening 22 is disposed to correspond to the laundry inlet 12.

The tub 20 may be connected to the first housing 11 by a damper 29. The damper 29 may absorb vibration generated when a first drum 30 rotates and damp the vibration transmitted to the first housing 11.

The first clothes treating apparatus 10 may include the first drum 30 provided to accommodate laundry.

The first drum 30 may be disposed inside the tub 20 such that a first drum opening 32 provided on one side corresponds to the laundry inlet 12 and the tub opening 22. Laundry may be received into, or taken out of, the first drum 30 by sequentially passing through the laundry inlet 12, the tub opening 22, and the first drum opening 32.

The first drum 30 may perform a respective operation corresponding to washing, rinsing, and/or spin-drying while rotating inside the tub 20. A plurality of through holes 34 is formed in a cylindrical wall of the first drum 30 so that water stored in the tub 20 may flow into or out of the first drum 30. At least one first lifter 35 may be installed on an inner circumferential surface of the first drum 30 so that laundry may be lifted and dropped as the first drum 30 rotates.

The first clothes treating apparatus 10 may include a first driving device 40 configured to rotate the first drum 30. The first driving device 40 may include a first driving motor 41 and a first rotating shaft 42 provided to transmit a driving force generated by the first driving motor 41 to the first drum 30. The first rotating shaft 42 may pass through the tub 20 to be connected to the first drum 30.

The first driving device 40 may perform each operation according to the washing, rinsing, and/or spin-drying or drying process by rotating the first drum 30 forwardly or reversely.

The first clothes treating apparatus 10 may include a water supply device 50 configured to supply water to the tub 20. The water supply device 50 may include a water supply pipe 51 and a water supply valve 52 provided on the water supply pipe 51. The water supply pipe 51 may be connected to an external water supply source. The water supply pipe 51 may extend from the external water supply source to a detergent supply device 53 and/or the tub 20. Water may be supplied to the tub 20 through the detergent supply device 53. Water may be supplied to the tub 20 without passing through the detergent supply device 53.

Figure 6:
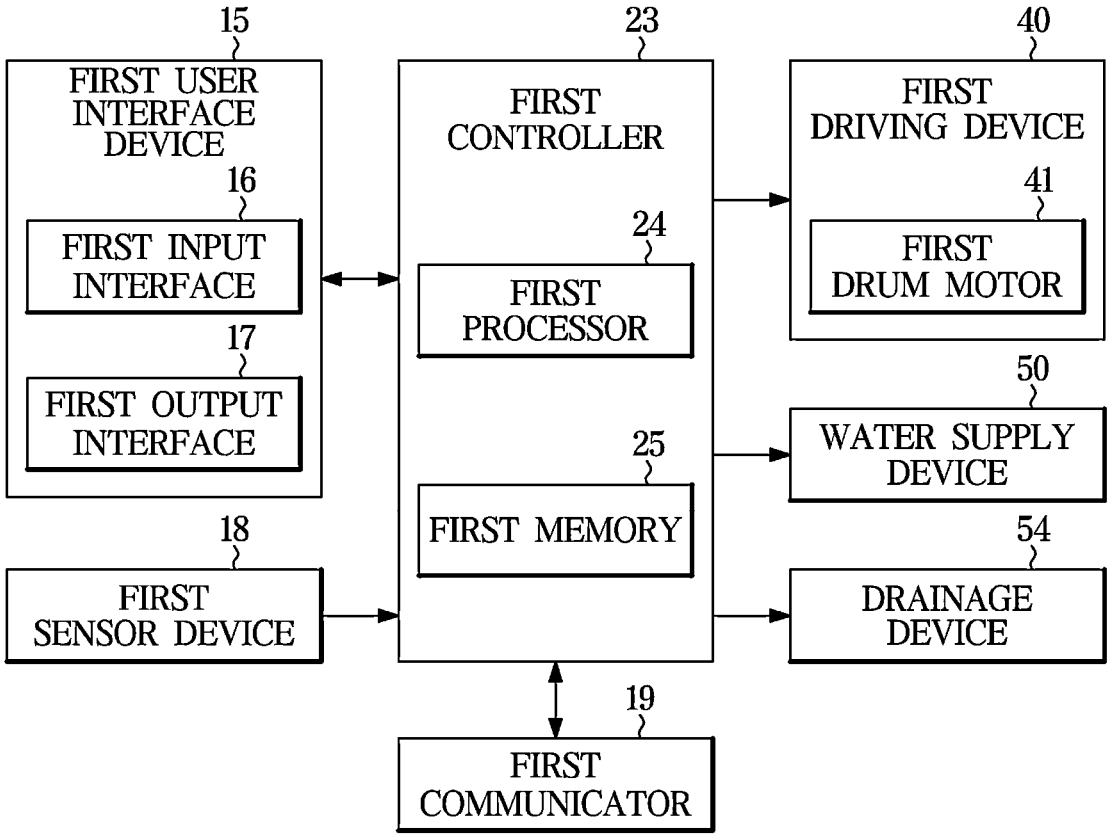
FIG. 6 is a control block diagram of a first clothes treating apparatus according to an embodiment of the disclosure.

The water supply valve 52 may open or close the water supply pipe 51 in response to an electrical signal from a first controller 23 (see FIG. 6). The water supply valve 52 may allow or block the supply of water to the tub 20 from the external water supply source. The water supply valve 52 may include, for example, a solenoid valve for opening and closing in response to an electrical signal.

The first clothes treating apparatus 10 may include the detergent supply device 53 configured to supply detergent to the tub 20. The detergent supply device 53 may include a manual detergent dispenser in which a user is required to input detergent to be used for each washing, and an automatic detergent dispenser that stores a large amount of detergent and automatically inputs a predetermined amount of detergent during washing. The detergent supply device 53 may include a detergent box for storing detergent. The detergent supply device 53 may be configured to supply detergent into the tub 20 during a water supply process. Water supplied through the water supply pipe 51 may be mixed with detergent through the detergent supply device 53. Water mixed with the detergent may be supplied to the tub 20. Here, detergent may be used as a term encompassing pre-washing detergent, main washing detergent, fabric softener, bleach, and the like, and the detergent box may be divided into a pre-washing detergent storage area for, a main washing detergent storage area, a fabric softener storage area, and a bleach storage area.

The first clothes treating apparatus 10 may include a drainage device 54 configured to discharge water contained in the tub 20 to the outside. The drainage device 54 may include a drain pipe 55 extending from a lower side of the tub 20 to the outside of the first housing 11, a drain valve 56 provided on the drain pipe 55 to open and close the drain pipe 55, and a pump 57 provided on the drain pipe 55. The pump 57 may pump water in the drain pipe 55 to the outside of the first housing 11.

According to various embodiments, the first clothes treating apparatus 10 may further include a heater for heating water stored in the tub 20.

According to various embodiments, the first clothes treating apparatus 10 may further include a heater for heating water supplied through the water supply device 50.

The second clothes treating apparatus 60 may be a washing machine or a dryer. For example, the second clothes treating apparatus 60 may be a dryer.

Referring to FIG. 4 and FIG. 5, the second clothes treating apparatus 60 according to various embodiments may include a second housing 61 accommodating various components therein. The second housing 61 may be provided in the form of a box having an object inlet 62 formed on one side thereof.

The second clothes treating apparatus 60 may include a second front frame 61*a* forming a front surface thereof. The object inlet 62 may be formed on the second front frame 61*a*.

The second clothes treating apparatus 60 may include a second door 63 provided to open and close the object inlet 62. The second door 63 may be rotatably mounted to the second housing 61 by a second hinge 64. At least a portion of the second door 63 may be transparent or translucent so that the inside of the second housing 61 is visible.

The second clothes treating apparatus 60 may include a second drum 70 provided to accommodate an object. The second drum 70 may be disposed inside the second housing 61 such that a second drum opening 72 provided on one side corresponds to the object inlet 62. The object may be received into, or taken out of, the second drum 70 by sequentially passing through the object inlet 62 and the second drum opening 72. The second drum 70 may be rotatably provided within the second housing 61.

The second clothes treating apparatus 60 may include a second driving device 73 configured to rotate the second drum 70. The second driving device 73 may include a second driving motor and a second rotating shaft provided to transmit a driving force generated by the second driving motor to the second drum 70.

The second drum 70 may include an air inlet 71 through which air is introduced into the second drum 70. Air inside the second drum 70 may be discharged to the outside of the second drum 70 through the second drum opening 72. The air inlet 71 may be located on a side opposite to a side of the second drum 70 where the second drum opening 72 is located. For example, the air inlet 71 may be located at a rear side of the second drum 70, and the second drum opening 72 may be located at a front side of the second drum 70.

The hot dry air may flow into the second drum 70 through the air inlet 71 and dry the object accommodated in the second drum 70. Air containing a large amount of moisture after drying the object may be discharged from the second drum 70 through the second drum opening 72.

At least one second lifter 74 may be provided inside the second drum 70. The second lifter 74 may lift and drop the object so that the object comes into contact with the hot air while floating in an inner space of the second drum 70.

A heat pump 80 configured to heat and condense air may be provided within the second housing 61. An evaporator 81, a condenser 82, a compressor 83, an expansion device, and the like forming the heat pump 80 may be disposed below the second drum 70. Refrigerant may be circulated through a series of processes leading to compression-condensation-expansion-evaporation. More specifically, the heat pump 80 may include the evaporator 81, the condenser 82, the compressor 83, and the expansion device. The evaporator 81 and the condenser 82 may exchange heat with air.

The compressor 83 may compress and discharge the refrigerant in a high-temperature and high-pressure state, and the discharged refrigerant may flow into the condenser 82. The condenser 82 may condense the compressed refrigerant and dissipate heat to the surroundings through the condensation process. The expansion device may expand the high-temperature and high-pressure refrigerant condensed in the condenser 82 to a low-pressure state. The evaporator 81 may evaporate the expanded refrigerant and may take away heat from the surroundings through the evaporation process.

As an operating RPM of the compressor 83 increases, the amount of heat released to the surroundings through the condensation process of the condenser 82 may increase.

When an object is put into the second clothes treating apparatus 60 and operated in a drying mode, high-temperature and high-humidity air discharged from the second drum 70 may pass through the evaporator 81. Accordingly, the high-temperature and high-humidity air discharged from the second drum 70 may be cooled while passing through the evaporator 81 and thus changed into low-temperature dry air. At this time, condensed water may be generated as the high-temperature and high-humidity air is cooled in the evaporator 81. The condensed water may be moved to a recovery water container or drained to the outside of the second housing 61. Air in a low-temperature dry state after passing through the evaporator 81 may pass through the condenser 82. Accordingly, the low-temperature dry air discharged from the evaporator 81 is heated while passing through the condenser 82 and thus changed into high-temperature dry air. The high-temperature dry air may flow into the second drum 70 through the air inlet 71 to dry the object. As the object is dried, the high-temperature and high-humidity air containing a large amount of moisture may be discharged through the second drum opening 72. The discharged air may pass through the evaporator 81 again. In summary, the air may dry the object accommodated in the second drum 70 while circulating inside the second housing 61.

In the drying mode, a closed type flow path may be formed inside the second housing 61 of the second clothes treating apparatus 60. Here, the closed type flow path may be an air movement path (see the arrow in FIG. 5) formed to circulate the air inside the second housing 61 through the heat pump 80 and the second drum 70. The closed type flow path may not communicate with the outside of the second housing 61 so that air outside the second housing 61 does not flow in or out. In other words, the flow of air may form a closed loop.

The second clothes treating apparatus 60 may include a heater 86 provided on the closed type flow path. The heater 86 may be implemented through a heating coil, but is not limited thereto, and may be implemented through various known devices. The heater 86 may further heat the air heated while passing through the condenser 82 or heat the air drawn in from the outside without being heated through the heat pump 80.

Referring to FIG. 4, the second clothes treating apparatus 60 may include a housing opening 69 provided on a front surface of the second housing 61 to access the heat pump 80. A filter device 96 may be mounted inside the second housing 61 through the housing opening 69. More specifically, the filter device 96 may be detachably mounted in a device accommodating portion 68 formed inside the second housing 61 through the housing opening 69. When the filter device 96 is mounted in the device accommodating portion 68, the second clothes treating apparatus 60 may perform the drying mode (drying operation) for drying objects, such as clothes. In addition, a housing cover 67 may be provided on the front surface of the second housing 61 to open and close the housing opening 69.

With the housing cover 67 closing the housing opening 69, a front surface of the housing cover 67 and the front surface of the second housing 61 are connected to form a smoothly connected surface without a step. When the filter device 96 is not mounted inside the second housing 61, the user may access the heat pump 80 through the housing opening 69. When the dryer has been used for a long time, foreign substances such as lint may accumulate on the heat pump and may be removed by the user these foreign substances through the housing opening 69.

The filter device 96 may be detachably mounted on the second clothes treating apparatus 60. More specifically, the filter device 96 may be detachably mounted inside the second housing 61 through the housing opening 69. The filter device 96 may be mounted in the device accommodating portion 68 or may be separate from the device accommodating portion 68.

A fan 90 may be disposed below the second drum 70. The fan 90 may circulate air inside the second housing 61. The fan 90 may form a circulating airflow passing through the second drum 70 inside the second housing 61.

The second clothes treating apparatus 60 may include a fan motor 91 configured to rotate the fan 90.

The fan 90 may be rotated by a driving force generated from the fan motor 91.

According to various embodiments, the fan motor 91 for rotating the fan 90 and a second drum motor 73*a* for rotating the second drum 70 may have the same configuration.

In an embodiment, one of the motors 91 and 73*a* may be connected to different rotating shafts to simultaneously rotate the fan 90 and the second drum 70.

When one of the motors 91 and 73*a* is connected to different rotating shafts to simultaneously rotate the fan 90 and the second drum 70, a rotational speed of the fan 90 and a rotational speed of the second drum 70 may be different from each other. For example, the rotational speed of the fan 90 may be faster than the rotational speed of the second drum 70.

According to various embodiments, the fan motor 91 for rotating the fan 90 and the second drum motor 73*a* for rotating the second drum 70 may be provided independently of each other.

FIG. 6 is a control block diagram of the first clothes treating apparatus according to an embodiment.

Referring to FIG. 6, in an embodiment, the first clothes treating apparatus 10 may include a first user interface device 15, the first driving device 40, the water supply device 50, the drainage device 54, a first sensor device 18, a first communicator 19, and the first controller 23.

The first user interface device 15 may provide a user interface for interaction between the user and the first clothes treating apparatus 10.

The first user interface device 15 may include at least one first input interface 16 and at least one first output interface 17.

In an embodiment, the first user interface device 15 may be positioned on one side of the first housing 11, but the position of the first user interface device 15 is not limited thereto.

The at least one first input interface 16 may convert sensory information received from the user into an electrical signal.

The at least one first input interface 16 may include a power button, an operation button, a course selection dial (or course selection button), and washing/rinsing/spin-drying setting buttons. The at least one first input interface 16 may include, for example, a tact switch, a push switch, a slide switch, a toggle switch, a micro switch, a touch switch, a touch pad, a touch screen, a jog dial, and/or a microphone, and the like.

The at least one first output interface 17 may transmit various data associated with an operation of the first clothes treating apparatus 10 to the user by generating sensory information.

For example, the at least one first output interface 17 may transmit information associated with a washing course, an operating time of the first laundry handling apparatus 10, and washing/rinsing/spin-drying settings to the user. Information about the operation of the first clothes treating apparatus 10 may be output through a screen, indicator, voice, and the like. The at least one first output interface 17 may include, for example, a liquid crystal display (LCD) panel, a light emitting diode (LED) panel, a speaker, and the like.

The washing course may include washing settings (e.g., washing temperature, number of rinsing, spin-drying intensity, etc.) which are preset by a designer of the first clothes treating apparatus 10 depending on the type (e.g., blanket, underwear, etc.) and material (e.g., wool, etc.) of laundry. For example, standard washing may include washing settings that may be applied to most laundry. Blanket washing may include washing settings optimized for washing a blanket. The washing course may be classified as, for example, standard washing, strong washing, delicate clothing washing, blanket washing, baby clothing washing, towel washing, small amount washing, boiling washing, power saving washing, outdoor clothing washing, rinsing/spin-drying, spin-drying, and the like.

According to various embodiments, the washing course may include a plurality of courses tailored to the needs of the user. For example, the washing course may include an energy saving course, a time saving course, a low noise course, and the like.

The energy saving course corresponds to a course for minimizing the energy required to perform a washing cycle. When the first clothes treating apparatus 10 performs the washing cycle corresponding to the energy saving course, an operation of the heater for heating water stored in the tub 20 may be minimized.

The time saving course corresponds to a course for minimizing the time required to perform the washing cycle. When the first clothes treating apparatus 10 performs the washing cycle corresponding to the time saving course, the number of times of washing process, rinsing process, and/or spin-drying process may be minimized, or the time required for washing process, rinsing process, and/or spin-drying process may be minimized.

The low noise course corresponds to a course for minimizing the noise generated from the first clothes treating apparatus 10 during the washing cycle. When the first clothes treating apparatus 10 performs the washing cycle corresponding to the low noise course, a maximum RPM of the first drum 30 may be minimized in the washing process, the rinsing process, and/or the spin-drying process.

In the present disclosure, courses according to special needs of the user, such as the energy saving course, the time saving course, and the low noise course, may be defined as specialized courses.

In the present disclosure, remaining courses, excluding the specialized courses (e.g., standard courses), may be defined as general courses.

A first memory 25 may store algorithms of a plurality of the washing courses corresponding to the plurality of washing courses. The algorithms of the plurality of washing courses refer to algorithms for controlling a plurality of components (e.g., the first driving device 40, the water supply device 50, the drainage device 54, and/or the heater) in the washing cycle.

A first processor 24 may perform a washing course based on an algorithm of an operation course set based on a user input among the algorithms of the plurality of washing courses stored in the first memory 25.

The first driving device 40 may include the first drum motor 41 providing a driving force for rotating the first drum 30. The first driving device 40 may operate based on a control signal from the first controller 23.

The water supply device 50 may include the water supply valve 52 provided to open and close the water supply pipe 51 extending from an external water supply source to the detergent supply device 53 and/or the tub 20. The water supply valve 52 may be opened and closed based on a control signal from the first controller 23.

The drainage device 54 may include the drainage pump 57 provided to discharge water from the tub 20 to the outside of the washing machine housing 11. The drainage pump 57 may operate based on a control signal from the first controller 23.

The first sensor device 18 may include at least one sensor provided to obtain information associated with an operating state of the first clothes treating apparatus 10.

For example, the first sensor device 18 may include at least one of a water level sensor provided to detect a water level of the tub 20, a sensor provided to detect an operating state of the first driving device 40, a flow sensor provided to detect a flow rate flowing into the tub 20 through the water supply device 50, and a sensor provided to detect an operating state of the drainage device 54.

According to various embodiments, the first sensor device 18 may include at least one sensor provided to detect a weight of laundry received in the first drum 30.

According to various embodiments, the first sensor device 18 may include a vibration sensor provided to detect a vibration value of the tub 20. The vibration sensor may detect vibration of the tub 20. More specifically, the vibration sensor may detect vibration of the tub 20 generated by rotation of the first drum 30 during the washing cycle (e.g., the spin-drying process). Eccentricity of the first drum 30 may occur due to unbalance of the laundry disposed inside the first drum 30, and vibration of the tub 20 may occur due to the eccentricity of the first drum 30. When a rotational speed of the first drum 30 increases in a state in which laundry is unbalanced, the vibration of the tub 20 may increase, and the noise caused by the vibration of the tub 20 may also increase.

According to various embodiments, although the first clothes treating apparatus 10 and the second clothes treating apparatus 60 are operated together, vibration of the tub 20 may increase due to frequency resonance.

The vibration sensor may output a vibration signal associated with vibration of the tub 20. An amplitude of the vibration signal may be defined as a vibration value when the tub 20 vibrates.

In an embodiment, the first controller 23 may convert a vibration signal in a time domain output from the vibration sensor into a vibration signal in a frequency domain, and may process the vibration signal in the frequency domain. The vibration sensor may include a 6-axis sensor capable of detecting displacement in 6 axes (X, Y, Z, Pitch, Roll, and Yaw).

The sensor provided to detect the operating state of the first driving device 40 may include, for example, a current sensor provided to measure a driving current applied to the first drum motor 41, but is not limited thereto.

The sensor provided to detect the operating state of the drainage device 54 may include, for example, a current sensor provided to measure a driving current applied to the drainage pump 57, but is not limited thereto.

The first clothes treating apparatus 10 may include the first communicator 19 for wired and/or wireless communication with external devices (e.g., servers, user devices, and/or other home appliances).

The user devices and/or other home appliances may include various electronic devices, such as smart phones, notebooks, laptops, smart watches, Internet of Things (IoT) hub devices, televisions, and/or other home appliances, such as the second clothes treating device 60, holder-type tablets, and speakers.

The first communicator 19 may include a short-range communication module and/or a long-range communication module.

The first communicator 19 may transmit data to an external device or receive data from an external device. For example, the first communicator 19 may establish communication with servers, user devices, and/or other home appliances, and transmit/receive various types of data.

To this end, the first communicator 19 may support establishment of a direct (e.g., wired) communication channel or wireless communication channel between external devices, and communication through the established communication channel. According to an embodiment, the first communicator 19 may include a wireless communication module (e.g., a cellular communication module, a short-range wireless communication module, or a global navigation satellite system (GNSS) communication module) or a wired communication module (e.g., a local area network (LAN) communication module, or a power line communication module). A corresponding communication module among these communication modules may communicate with external devices through a first network (e.g., a short-range communication network such as Bluetooth, wireless fidelity (Wi-Fi) direct, and infrared data association (IrDA)) or a second network (e.g., a long-range communication network such as a legacy cellular network, a 5G network, a next-generation telecommunications network, the Internet, and a computer network (e.g. LAN or WAN)). These various types of communication modules may be integrated as one component (e.g., a single chip) or implemented as a plurality of separate components (e.g., a plurality of chips).

The short-range wireless communication modules may include, but are not limited to, a Bluetooth communication module, a Bluetooth low energy (BLE) communication module, a near field communication module, a WLAN (Wi-Fi) communication module, a ZigBee communication module, an infrared data association (IrDA) communication module, a Wi-Fi direct (WFD) communication module, an ultra-wideband (UWB) communication module, an Ant+ communication module, a microwave (uWave) communication module, and the like.

The long-range communication modules may include communication modules that perform various types of long distance communications, and may include mobile communicators. The mobile communicator transfers and receives radio signals with at least one of a base station, an external terminal, and a server on a mobile communication network.

In an embodiment, the first communicator 19 may communicate with an external device such as a server, user device, and other home appliance through a nearby access point (AP). The access point may connect a local area network (LAN) to which the first clothes treating apparatus 10 and/or a user device and/or other home appliance are connected, to a wide area network (WAN) to which a server is connected. The first clothes treating apparatus 10 and/or the user device and/or the other home appliance may be connected to the server through the wide area network (WAN).

The first controller 23 may control various components (e.g., the first driving device 40, the water supply device 50, and the drainage device 54) of the first clothes treating apparatus 10. The first controller 23 may control various components of the first clothes treating apparatus 10 to perform at least one process including water supplying, washing, rinsing, and/or spin-drying depending on the user input. For example, the first controller 23 may control the first drum motor 41 of the first driving device 40 to adjust the rotational speed (i.e., RPM) of the first drum 30, control the water supply valve 52 of the water supply device 50 to supply water, or control the drainage pump 57 of the drainage device 54 to discharge water from the tub 20 to the outside.

The first controller 23 may include hardware, such as a central processing unit (CPU), a microcomputer (Micom), and a memory, and software, such as a control program. For example, the first controller 23 may include algorithms for controlling operations of the components in the first clothes treating apparatus 10, the at least one first memory 25 for storing data in the form of a program, and the at least one first processor 24 for performing the above-described operations and an operation, which will be described later, using data stored in the at least one first memory 25. The at least one first memory 25 and the at least one first processor 24 may be implemented as separate chips. The at least one first processor 24 may include one or more processor chips or may include one or more processing cores. The at least one first memory 25 may include one or more memory chips or one or more memory blocks. In addition, the at least one first memory 25 and the at least one first processor 24 may be implemented as a single chip.

Figure 7:
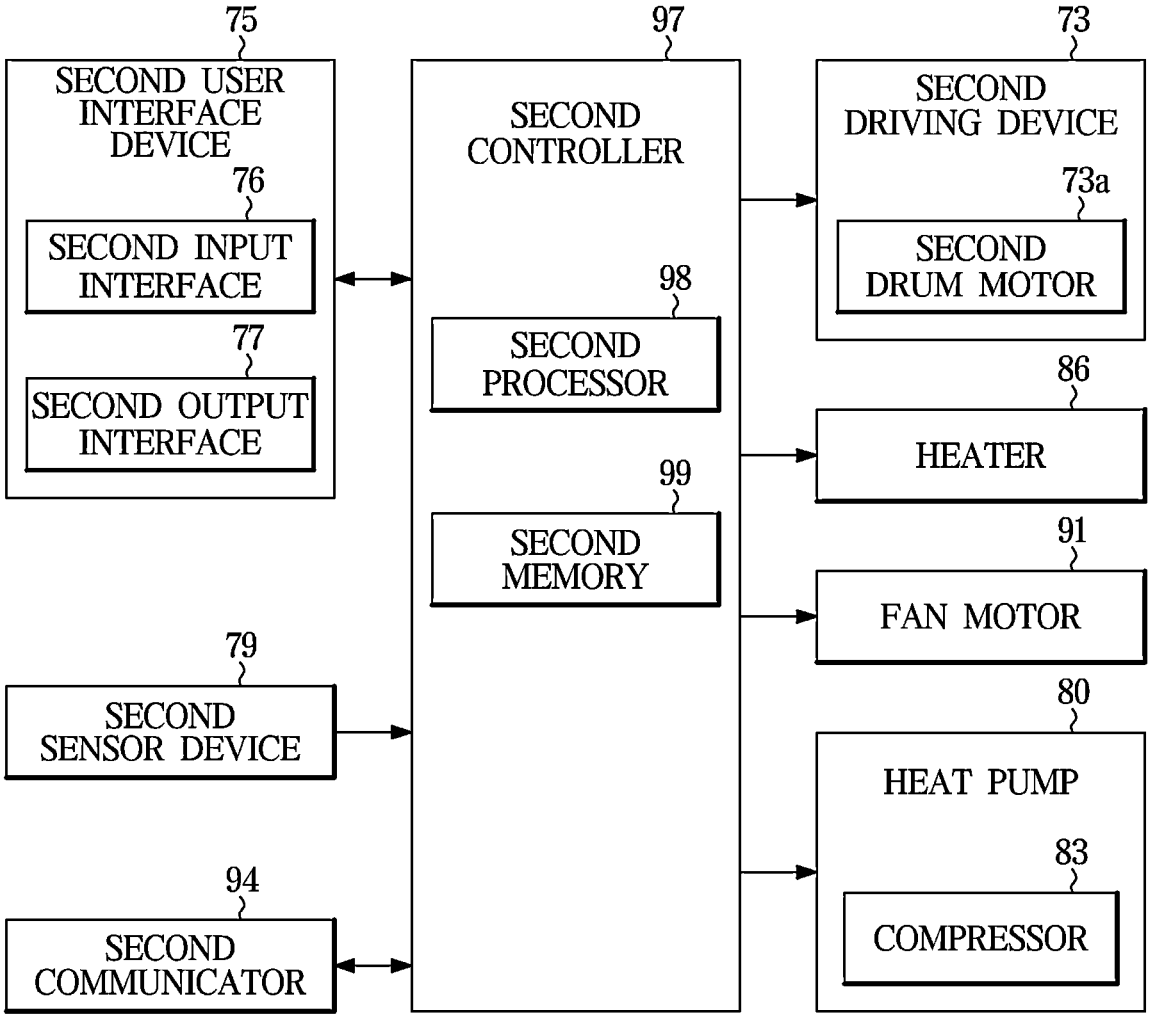
FIG. 7 is a control block diagram of a second clothes treating apparatus according to an embodiment of the disclosure.

FIG. 7 is a control block diagram of the second clothes treating apparatus according to an embodiment.

Referring to FIG. 7, in an embodiment, the second clothes treating apparatus 60 may include a second user interface device 75, the second driving device 73, the heater 86, the fan motor 91, the heat pump 80, a second communicator 94, a second sensor device 79, and a second controller 97.

The second user interface device 75 may provide a user interface for interaction between the user and the second clothes treating apparatus 60.

The second user interface device 75 may include at least one second input interface 76 and at least one second output interface 77.

In an embodiment, the second user interface device 75 may be disposed on one side of the second housing 61, but the position of the second user interface device 75 is not limited thereto.

The at least one second input interface 76 may convert sensory information received from the user into an electrical signal.

The at least one second input interface 76 may include a power button, an operation button, a course selection dial (or course selection button), a drying setting button, and a Wi-Fi button. The at least one second input interface 76 may include, for example, a tact switch, a push switch, a slide switch, a toggle switch, a micro switch, a touch switch, a touch pad, a touch screen, a jog dial, and/or a microphone, and the like.

The at least one second output interface 77 may transmit various data associated with an operation of the second clothes treating apparatus 60 to the user by generating sensory information.

For example, the at least one second output interface 77 may transmit information associated with a drying course, an operating time of the second clothes treating apparatus 60, and a drying setting to the user. Information about the operation of the second clothes treating apparatus 60 may be output through a screen, indicator, voice, and the like. The at least one second output interface 77 may include, for example, a LCD panel, a LED panel, a speaker, and the like.

The drying course may include drying settings (e.g., drying temperature, drying time, drying intensity, etc.) which are preset by a designer of the second clothes treating apparatus 60 depending on the type (e.g., blanket, underwear, etc.) and material (e.g., wool, etc.) of an object. For example, standard drying may include drying settings that may be applied to most objects. Blanket drying may include drying settings optimized for drying a blanket. The drying course may be classified as, for example, standard drying, strong drying, delicate clothing drying, blanket drying, baby clothing drying, towel drying, small amount drying, power saving drying, outdoor clothing drying, and the like.

According to various embodiments, the drying course may include a plurality of courses tailored to the needs of the user. For example, the drying course may include an energy saving course, a time saving course, a low noise course, and the like.

The energy saving course corresponds to a course for minimizing the energy required to perform a drying process. When the second clothes treating apparatus 60 performs the drying process corresponding to the energy saving course, an operation of the heater 86 may be minimized.

The time saving course corresponds to a course for minimizing the time required to perform the drying process. When the second clothes treating apparatus 60 performs the drying process corresponding to the time saving course, an operating time of the heater 86 and/or an operating frequency of the compressor 83 may increase.

The low noise course corresponds to a course for minimizing the noise generated from the second clothes treating apparatus 60 during the drying process. When the second clothes treating apparatus 60 performs the drying process corresponding to the low noise course, a maximum RPM of the second drum 70 may be minimized.

In the present disclosure, courses according to special needs of the user, such as the energy saving course, the time saving course, and the low noise course, may be defined as specialized courses.

In the present disclosure, remaining courses, excluding the specialized courses (e.g., standard courses), may be defined as general courses.

A second memory 99 may store algorithms of a plurality of the drying courses corresponding to the plurality of drying courses. The algorithms of the plurality of drying courses refer to algorithms for controlling a plurality of components (e.g., the second driving device 73, the heater 86, the fan motor 91, and/or the compressor 83) in the drying process.

A second processor 98 may perform a drying process based on an algorithm of an operation course set based on the user input among the algorithms of the plurality of drying courses stored in the second memory 99.

The second driving device 73 may include the second drum motor 73*a* providing a driving force for rotating the second drum 70. The second driving device 73 may operate based on a control signal from the second controller 97.

According to various embodiments, the second controller 97 may control the second driving device 73 based on an algorithm of the operation course selected by the user.

The heater 86 may further heat the air heated while passing through the condenser 82 or heat the air drawn in from the outside without being heated through the heat pump 80.

The heater 86 may operate based on a control signal from the second controller 97.

According to various embodiments, the second controller 97 may control the heater 86 based on the algorithm of the operation course selected by the user.

The fan motor 91 may rotate the fan 90 for circulating air in the second housing 61.

The fan motor 91 may operate based on a control signal from the second controller 97.

According to various embodiments, the second controller 97 may control the fan motor 91 based on the algorithm of the operation course selected by the user.

As described above, the fan motor 91 for rotating the fan 90 and the second drum motor 73*a* for rotating the second drum 70 may have the same configuration.

In an embodiment, when one of the motors 91 and 73*a* is connected to different rotating shafts to simultaneously rotate the fan 90 and the second drum 70, the second controller 97 may drive one of the motors 91 and 73*a* at target RPMs corresponding to a target RPM of the fan 90 or a target RPM of the second drum 70.

According to various embodiments, when the fan motor 91 for rotating the fan 90 and the second drum motor 73*a* for rotating the second drum 70 are provided independently of each other, the second controller 97 may drive the fan motor 91 based on the target RPM of the fan 90 and drive the second drum motor 73*a* based on the target RPM of the second drum 70.

The heat pump 80 configured to generate hot air to be supplied to the second drum 70, may include the compressor 83 for compressing the refrigerant.

The compressor 83 may operate based on a control signal from the second controller 97.

According to various embodiments, the second controller 97 may control the compressor 83 based on the algorithm of the operation course selected by the user.

The second sensor device 79 may include at least one sensor provided to obtain information associated with an operating state of the second clothes treating apparatus 60.

According to various embodiments, the second sensor device 79 may include at least one sensor provided to detect a weight of an object received in the second drum 70.

According to various embodiments, the second sensor device 79 may include a temperature sensor provided to detect a temperature in the second housing 61 and/or a sensor provided to detect an operating state of the second driving device 73.

The temperature sensor detecting the temperature in the second housing 61 may be provided anywhere inside the second housing 61. According to various embodiments, the temperature sensor may be provided on an outlet side of the condenser 82 or may be provided on a downstream side of the heater 86.

According to various embodiments, the second sensor device 79 may include a vibration sensor provided to detect a vibration value of the second housing 61.

The second clothes treating apparatus 60 may include the second communicator 94 for wired and/or wireless communication with external devices (e.g., servers, user devices, and/or other home appliances).

The user devices and/or other home appliances may include various electronic devices, such as smartphones, notebooks, laptops, smart watches, IoT hub devices, other home appliances such as a television and/or the second clothes treating apparatus 60, holder-type tablets, and speakers.

The second communicator 94 may include a short-range communication module and/or a long-range communication module.

The second communicator 94 may transmit data to an external device or receive data from an external device. For example, the second communicator 94 may establish communication with servers, user devices, and/or other home appliances, and transmit/receive various types of data.

To this end, the second communicator 94 may support establishment of a direct (e.g., wired) communication channel or wireless communication channel between external devices, and communication through the established communication channel. According to an embodiment, the second communicator 94 may include a wireless communication module (e.g., a cellular communication module, a short-range wireless communication module, or a global navigation satellite system (GNSS) communication module) or a wired communication module (e.g., a local area network (LAN) communication module, or a power line communication module). A corresponding communication module among these communication modules may communicate with external devices through a first network (e.g., a short-range communication network such as Bluetooth, wireless fidelity (Wi-Fi) direct, and infrared data association (IrDA)) or a second network (e.g., a long-range communication network such as a legacy cellular network, a 5G network, a next-generation telecommunications network, the Internet, and a computer network (e.g. LAN or WAN)). These various types of communication modules may be integrated as one component (e.g., a single chip) or implemented as a plurality of separate components (e.g., a plurality of chips).

The short-range wireless communication modules may include, but are not limited to, a Bluetooth communication module, a Bluetooth low energy (BLE) communication module, a near field communication module, a WLAN (Wi-Fi) communication module, a ZigBee communication module, an infrared data association (IrDA) communication module, a Wi-Fi direct (WFD) communication module, an ultra-wideband (UWB) communication module, an Ant+ communication module, a microwave (uWave) communication module, and the like.

The long-range communication modules may include communication modules that perform various types of long distance communications, and may include mobile communicators. The mobile communicator transfers and receives radio signals with at least one of a base station, an external terminal, and a server on a mobile communication network.

In an embodiment, the second communicator 94 may communicate with an external device such as a server, user device, and other home appliance through a nearby access point. The access point may connect a local area network (LAN) to which the second clothes treating apparatus 60 and/or a user device and/or other home appliance are connected, to a wide area network (WAN) to which a server is connected. The second clothes treating apparatus 60 and/or the user device and/or the other home appliance may be connected to the server through the wide area network (WAN).

The second controller 97 may control various components (e.g., the second driving device 73, the heater 86, the fan motor 91, and/or the compressor 83) of the second clothes treating apparatus 60. The second controller 97 may control various components of the second clothes treating apparatus 60 to perform the drying process depending on the user input. For example, the second controller 97 may control the second drum motor 73*a* of the second driving device 73 to adjust the rotational speed (i.e., RPM) of the second drum 70, control the operation of the heater 86 to quickly heat air in the second drum 70, control an operation of the compressor 83 to generate hot air to be supplied to the second drum 70, or control an operation of the fan motor 91 to circulate hot air generated by the heat pump 80 into the second drum 70.

The second controller 97 may include hardware such as a CPU, a Micom and a memory, and software such as a control program. For example, the second controller 97 may include algorithms for controlling operations of the components in the second clothes treating apparatus 60, the at least one second memory 99 for storing data in the form of a program, and the at least one second processor 98 for performing the above-described operations and operations, which will be described later, using data stored in the at least one second memory 99. The second memory 99 and the second processor 98 may be implemented as separate chips. The second processor 98 may include one or more processor chips or may include one or more processing cores. The second memory 99 may include one or more memory chips or may include one or more memory blocks. The second memory 99 and the second processor 98 may be implemented as a single chip.

Figure 8:
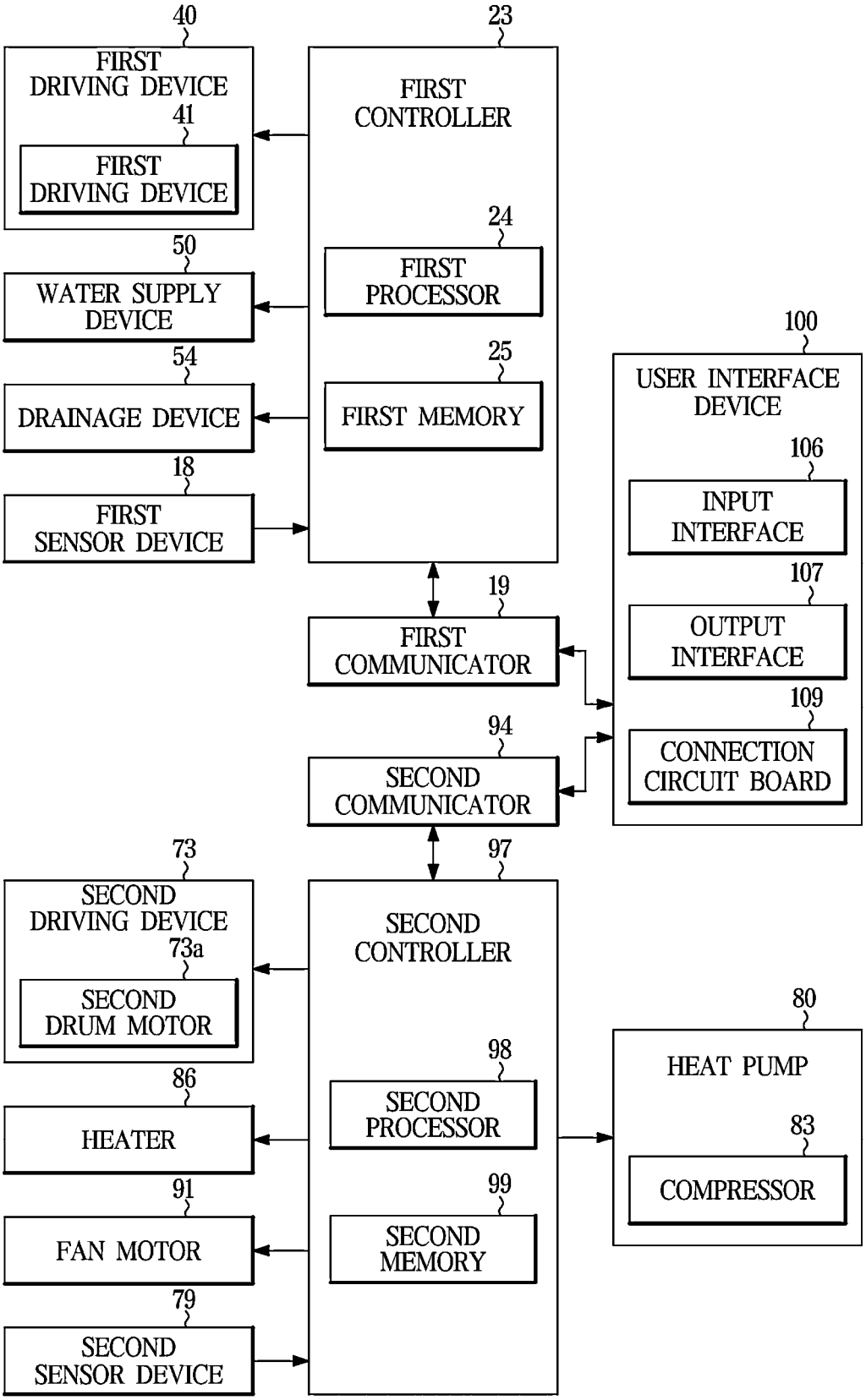
FIG. 8 is a control block diagram of a clothes treating system according to an embodiment of the disclosure.

FIG. 8 is a control block diagram of the clothes treating system according to an embodiment.

Referring to FIG. 8, the clothes treating system 1 according to an embodiment may include the first clothes treating apparatus 10 and the second clothes treating apparatus 60.

The first clothes treating apparatus 10 and the second clothes treating apparatus 60 may be operatively and/or electrically connected to each other.

A variety of information obtained from the first clothes treating apparatus 10 may be transmitted to the second clothes treating apparatus 60, and a variety of information obtained from the second clothes treating apparatus 60 may be transmitted to the first clothes treating apparatus 10.

In an embodiment, the clothes treating system 1 may include a user interface device 100.

The user interface device 100 may be provided in the first clothes treating apparatus 10 and/or the second clothes treating apparatus 60.

In an embodiment, the user interface device 100 may be disposed on one side surface of the first housing 11.

The user interface device 100 of the clothes treating system 1, which is a component for controlling both the first clothes treating apparatus 10 and the second clothes treating apparatus 60, may be defined as the integrated user interface device 100.

In an embodiment, as the clothes treating system 1 includes the user interface device 100, the first clothes treating apparatus 10 may not include the first user interface device 15 for controlling only the first clothes treating apparatus 10.

In an embodiment, as the clothes treating system 1 includes the user interface device 100, the second clothes treating apparatus 60 may not include the second user interface device 75 for controlling only the second clothes treating apparatus 60.

According to various embodiments, although the clothes treating system 1 includes the user interface device 100, the first clothes treating apparatus 10 may include the first user interface device 15 for controlling only the first clothes treating apparatus 10. As another example, although the clothes treating system 1 includes the user interface device 100, the second clothes treating apparatus 60 may include the second user interface apparatus 75 for controlling only the second clothes treating apparatus 60. As still another example, although the clothes treating system 1 includes the user interface device 100, the first clothes treating apparatus 10 may include the first user interface apparatus 15 for controlling only the first clothes treating apparatus 10 and the second clothes treating apparatus 60 may include the second user interface device 75 for controlling only the second clothes treating apparatus 60.

In other words, in an embodiment, the clothes treating system 1 may include the user interface device 100 for controlling the first clothes treating apparatus 10 and the second clothes treating apparatus 60, and the first user interface device 15 for controlling the first clothes treating apparatus 10 and/or the second user interface device 75 for controlling the second clothes treating apparatus 60.

The user interface device 100 may provide a user interface for interaction between the user and the clothes treating system 1. The user interface for interaction between the user and the clothes treating system 1 may refer to a user interface for interaction between the user and the first clothes treating apparatus 10 and the second clothes treating apparatus 60.

The user interface device 100 may include at least one input interface 106 and at least one output interface 107.

The at least one input interface 106 may convert sensory information received from the user into an electrical signal and transmit the electrical signal to the first clothes treating apparatus 10 and/or the second clothes treating apparatus 60.

The at least one input interface 106 may include a tact switch, a push switch, a slide switch, a toggle switch, a micro switch, a touch switch, a touch pad, a touch screen, a jog dial, and/or a microphone, and the like.

In an embodiment, the at least one input interface 106 may transmit a control command corresponding to a user input to the first controller 23 of the first clothes treating apparatus 10 and the second controller 97 of the second clothes treating apparatus 60.

The at least one output interface 107 may transmit various data associated with the operation of the first clothes treating apparatus 10 and the second clothes treating apparatus 60 to the user by generating sensory information.

The at least one output interface 107 may include an LCD panel, an LED panel, a speaker, and the like.

A panel on which the at least one input interface 106 and the at least one output interface 107 are formed may be defined as a control panel 101. The at least one input interface 106 and the at least one output interface 107 may be provided on the control panel 101.

The first clothes treating apparatus 10 and the second clothes treating apparatus 60 may communicate with each other by using the first communicator 19 of the first clothes treating apparatus 10 and the second communicator 94 of the second clothes treating apparatus 60.

In an embodiment, the first communicator 19 and the second communicator 94 may directly communicate with each other by using a device-to-device (D2D) wireless communication module (e.g., a Bluetooth module).

In an embodiment, the first communicator 19 and the second communicator 94 may communicate with each other through a server using a WAN.

According to various embodiments, the first communicator 19 and the second communicator 94 may include wired communication modules (e.g., communication connectors and/or communication wires), and the first clothes treating apparatus 10 and the second treating apparatus 60 may be connected to each other by wires.

According to various embodiments, the user interface device 100 may further include a connection circuit board 109. The connection circuit board 109 may be implemented as a printed circuit board (PCB).

The connection circuit board 109 may include a communication wire and/or a communication connector to be connected to the first communicator 19 and the second communicator 94.

The connection circuit board 109 may connect the first communicator 19 and the second communicator 94 by wire.

Each of the first communicator 19 and the second communicator 94 may be connected to the connection circuit board 109.

The connection circuit board 109 may mediate data exchange between the first controller 23 and the second controller 97.

For example, the connection circuit board 109 may transmit a signal transmitted from the first controller 23 through the first communicator 19 to the second controller 97 through the second communicator 94.

As another example, the connection circuit board 109 may transmit a signal transmitted from the second controller 97 through the second communicator 94 to the first controller 23 through the first communicator 19.

According to various embodiments, the connection circuit board 109 may transmit course information selected by the at least one input interface 106 to the first controller 23 through the first communicator 19.

According to various embodiments, the connection circuit board 109 may transmit course information selected by the at least one input interface 106 to the second controller 97 through the second communicator 94.

According to the present disclosure, as the user interface device 100 includes the connection circuit board 109, communication between the first clothes treating apparatus 10 and the second clothes treating apparatus 60 may be smoothly performed, and at the same time, communication between the user interface device 100 and the first clothes treating apparatus 10 and the second clothes treating apparatus 60 may be smoothly performed.

Figure 9:
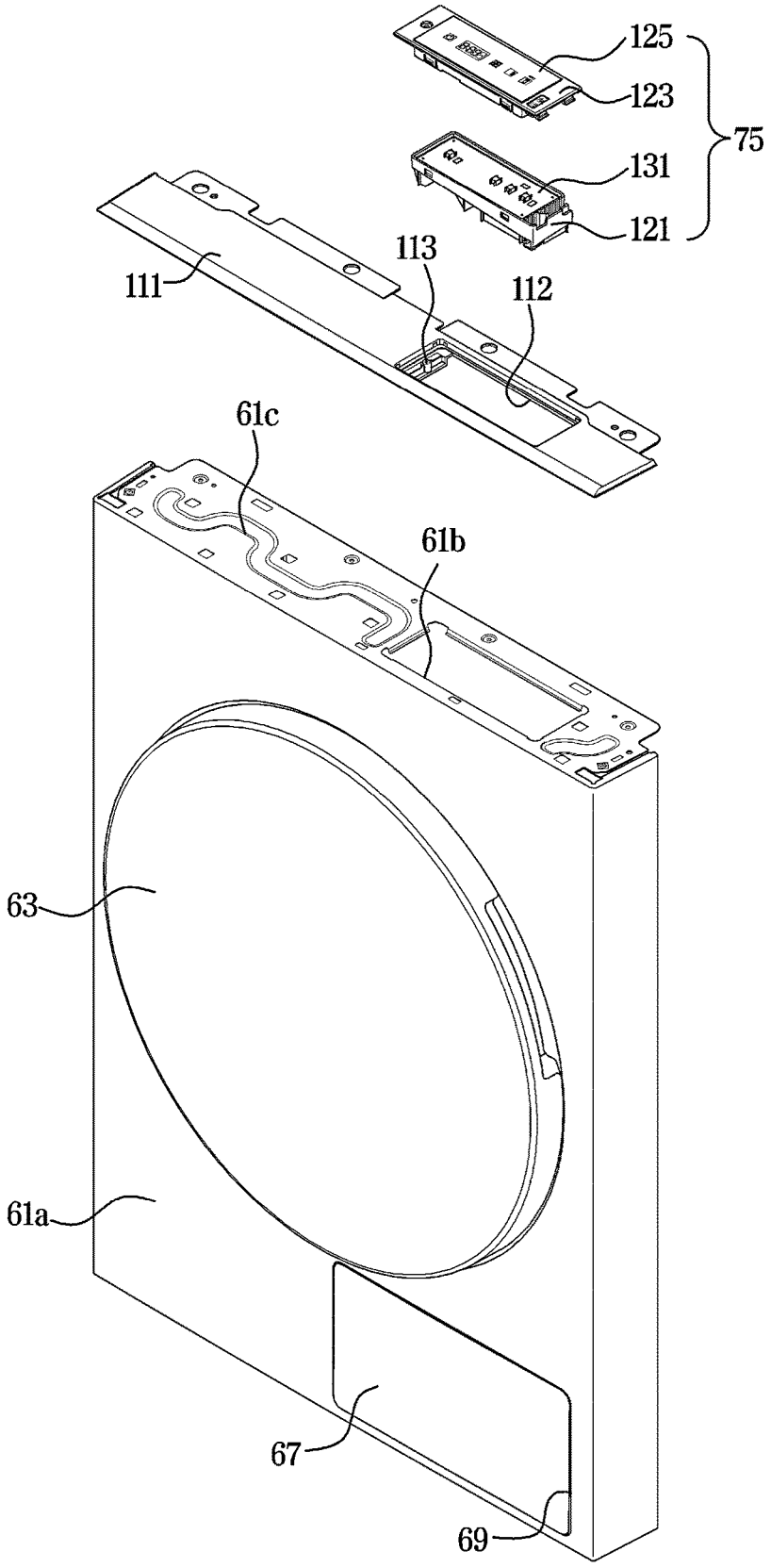
FIG. 9 is an exploded view illustrating components mounted on a front frame of a second clothes treating apparatus according to an embodiment of the disclosure.
Figure 10:
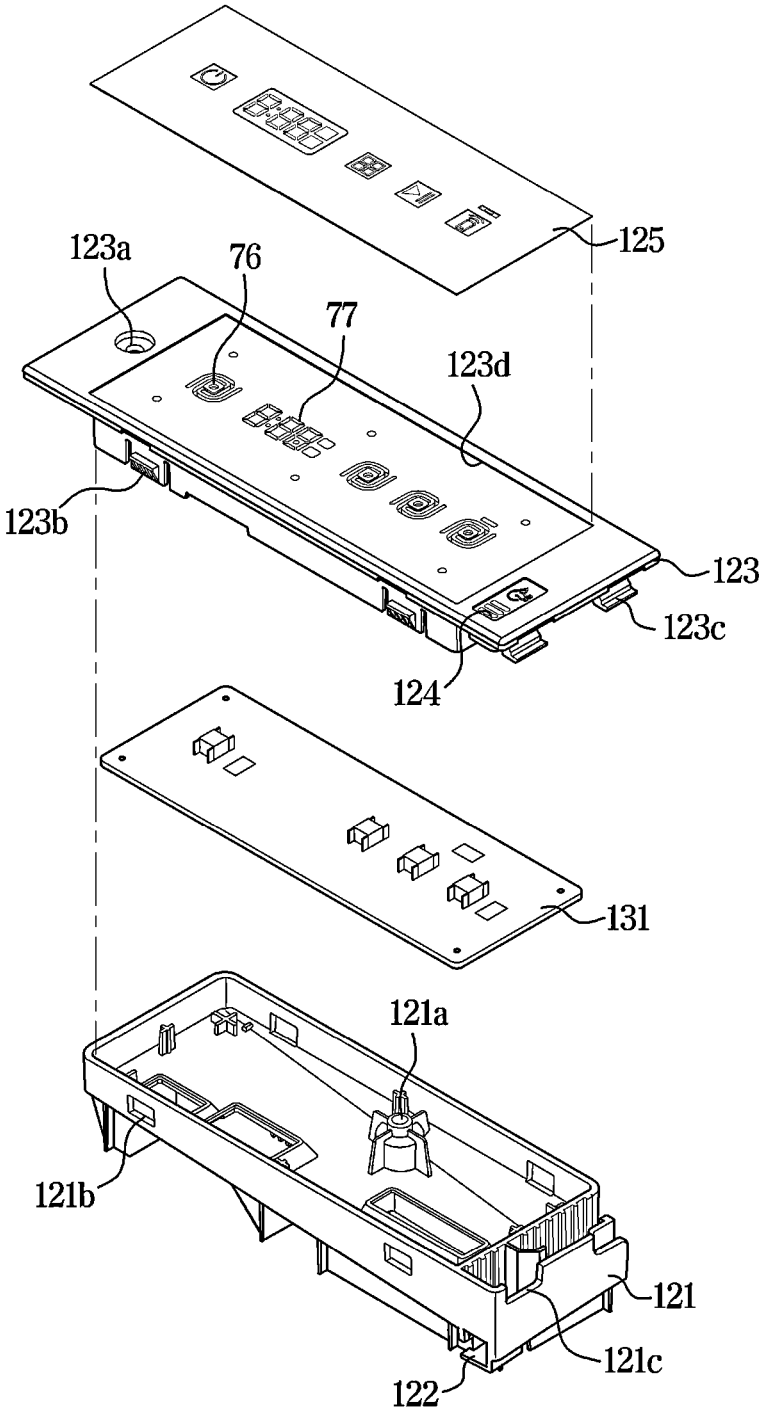
FIG. 10 is an exploded view illustrating a second user interface device according to an embodiment of the disclosure.
Figure 11:
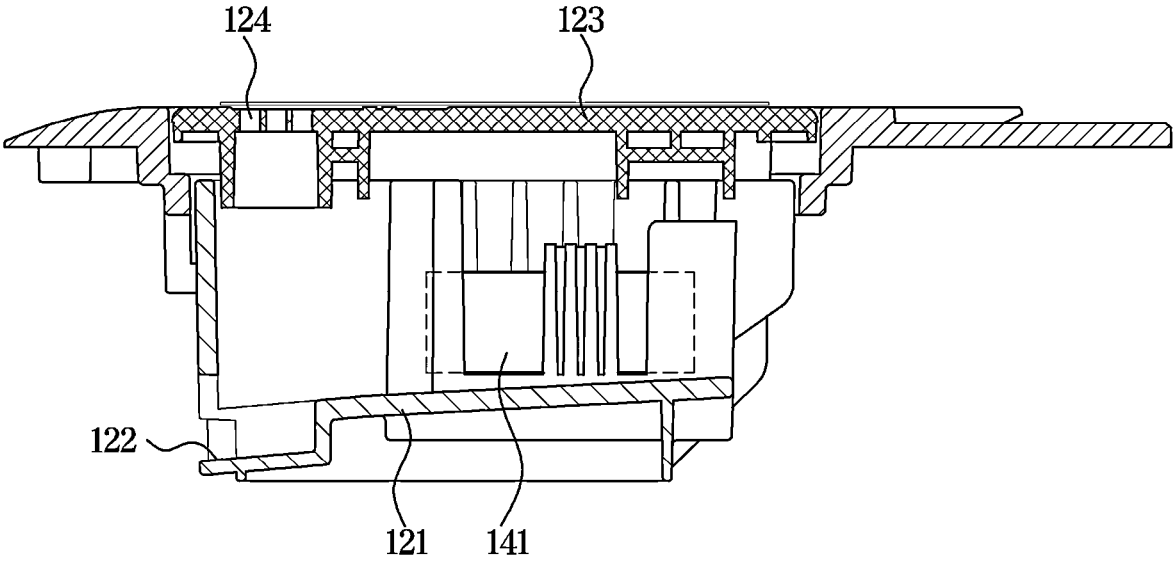
FIG. 11 is a view illustrating an interior of a second user interface device according to an embodiment of the disclosure.
Figure 12:
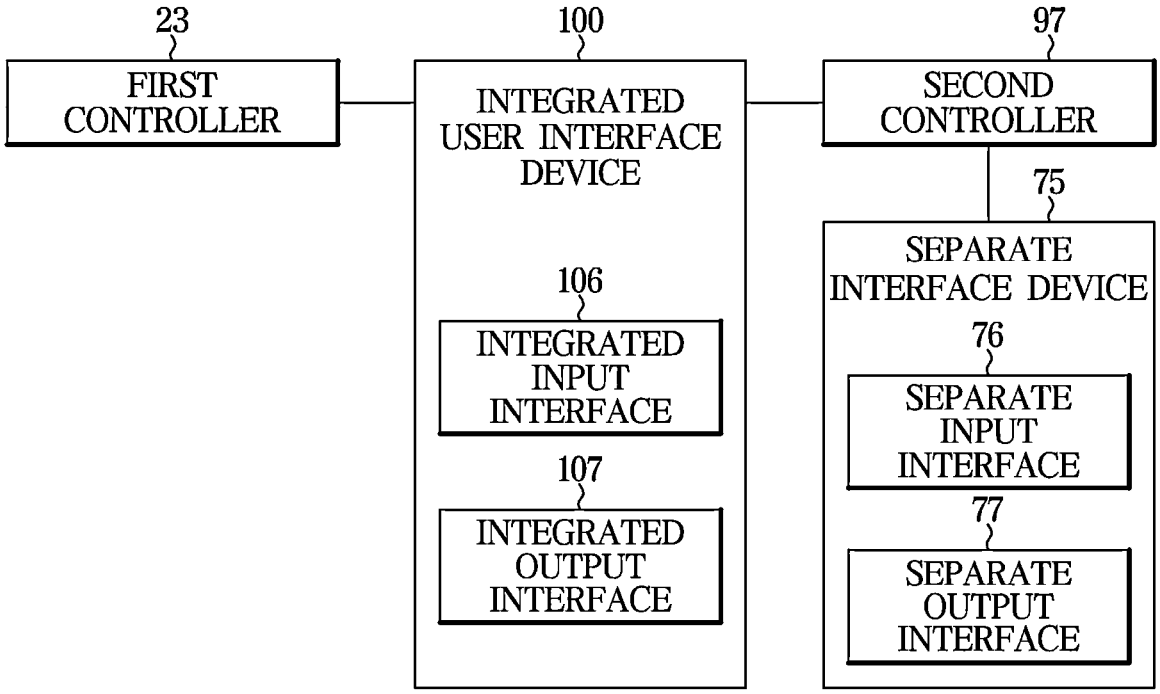
FIG. 12 is a control block diagram of a clothes treating system according to an embodiment of the disclosure.

FIG. 9 is an exploded view illustrating components mounted on a front frame of the second clothes treating apparatus according to an embodiment. FIG. 10 is an exploded view illustrating the second user interface device according to an embodiment. FIG. 11 is a view illustrating an interior of the second user interface device according to an embodiment. FIG. 12 is a control block diagram of the clothes treating system according to an embodiment.

According to an embodiment, the clothes treating system 1 may include the user interface device 100 for controlling both the first clothes treating apparatus 10 and the second clothes treating apparatus 60, and the second user interface device 75 for controlling only the second clothes treating apparatus 60. Hereinafter, for ease of description, the user interface device 100 for controlling both the first and second clothes treating apparatuses 10 and 60 is referred to as the integrated user interface device 100, the input interface 106 is referred to as the integrated input interface 106, and the output interface 107 is referred to as the integrated output interface 107. In addition, hereinafter, for ease of description, the second user interface device 75 for controlling only the second clothes treating apparatus 60 is referred to as the separate user interface device 75, the second input interface 76 is referred to as the separate input interface 76, and the second output interface 77 is referred to as the separate output interface 77.

The integrated user interface device 100 may be provided in the first clothes treating apparatus 10. The integrated user interface device 100 may be mounted on the first housing 11. The integrated user interface device 100 may be disposed on a front surface of the first clothes treating apparatus 10. The integrated user interface device 100 may be connected to the first controller 23 and the second controller 97 to control the first clothes treating apparatus 10 and the second clothes treating apparatus 60.

The integrated user interface device 100 may include the integrated input interface 106 receiving a user input, and the integrated output interface 107 displaying visualized information associated with the first and second clothes treating apparatuses 10 and 60.

The separate user interface device 75 may be provided in the second clothes treating apparatus 60. The separate user interface device 75 may be mounted on the second housing 61. The separate user interface device 75 may be disposed on an upper surface of the second clothes treating apparatus 60. The separate user interface device 75 may be connected to the second controller 97 to control the second clothes treating apparatus 60.

The separate user interface device 75 may include the separate input interface 76 receiving a user input, and the separate output interface 77 displaying visualized information associated with the second clothes treating apparatus 60.

The clothes treating system 1 according to an embodiment includes the separate user interface device 75 capable of controlling the second clothes treating device 60, so that the second clothes treating device 60 may be controlled when the integrated user interface device 100 does not operate. The second clothes treating apparatus 60 of the clothes treating system 1 according to an embodiment includes the separate user interface device 75, so that the second clothes treating device 60 may be controlled even when separated from the first clothes treating apparatus 10.

Referring to FIG. 9, the second housing 61 of the second clothes treating apparatus 60 may include the second front frame 61*a* forming the front surface of the second clothes treating apparatus 60. The second front frame 61*a* may form a part of both side surfaces of the second clothes treating apparatus 60. The second door 63 may be rotatably coupled to the second front frame 61*a*.

The second front frame 61*a* may include a frame opening 61*b* formed to mount the separate user interface device 75 thereon. The frame opening 61*b* may be formed on an upper surface of the second front frame 61*a*. The frame opening 61*b* may be formed to insert the separate user interface device 75. The frame opening 61*b* may be formed to correspond to a cap opening 112 of an upper cap 111.

The second front frame 61*a* may include a reinforcing portion 61*c* formed at a portion where the upper cap 111 is mounted. The reinforcing portion 61*c* may be formed by bending a part of the upper surface of the second front frame 61*a*. The reinforcing portion 61*c* may reinforce strength that may be weakened when the frame opening 61*b* is formed in the second front frame 61*a*.

The second housing 61 of the second clothes treating apparatus 60 may include the upper cap 111 mounted on an upper portion of the second front frame 61*a*. The upper cap 111 may form a part of the upper surface of the second clothes treating apparatus 60. The upper cap 111 may cover the upper surface of the second front frame 61*a*. The upper cap 111 may include a material different from that of the second front frame 61*a*.

The upper cap 111 may include the cap opening 112 formed to mount the separate user interface device 75. The cap opening 112 may be formed to allow the separate user interface device 75 to be inserted. The cap opening 112 may be formed to correspond to the frame opening 61*b* of the second front frame 61*a*.

A board cover 123 may be mounted on the upper cap 111. The upper cap 111 may include a cover mounting portion 113 to which the board cover 123 is mounted. In a state in which a cover fixing portion 123*a* of the board cover 123 is aligned with the cover mounting portion 113 of the upper cap 111, a fixing member is coupled thereto, so that the board cover 123 is mounted on the upper cap 111.

The second clothes treating apparatus 60 may include the separate user interface device 75 mounted on the second housing 61. The separate user interface device 75 may be mounted on the second housing 61. The separate user interface device 75 may be mounted on the upper cap 111 of the second housing 61.

The separate user interface device 75 may be formed on a surface substantially parallel to the upper surface of the second clothes treating apparatus 60. The separate user interface device 75 may be provided facing upwardly. The separate user interface device 75 may be positioned adjacent to an end of the upper cap 111 in a longitudinal direction.

Referring to FIG. 9 and FIG. 10, the separate user interface device 75 may include a circuit board 131. The circuit board 131 may be connected to the board cover 123. The circuit board 131 may transmit a control command to the second controller 97 based on a user command received from the separate input interface 76. The circuit board 131 may be implemented as a PCB.

The separate user interface device 75 may include a board case 121 provided to accommodate the circuit board 131. The board case 121 may cover the circuit board 131 to protect the circuit board 131 from foreign substances.

The board case 121 may be mounted on the board cover 123. The board case 121 may include a case fixing portion 121*a* to be fixed to the board cover 123. A fixing member is fixed to the case fixing portion 121*a* in a state in which the board case 121 and the board cover 123 are aligned with each other, so that the board case 121 may be fixed to the board cover 123.

The board case 121 may include a case coupling portion 121*b* to be coupled to the board cover 123. The case coupling portion 121*b* may be coupled to a cover coupling portion 123*b* of the board cover 123. A fixing member is fixed to the case fixing portion 121*a* in a state in which the case coupling portion 121*b* of the board case 121 and the cover coupling portion 123*b* of the board cover 123 are engaged with each other, so that the board case 121 may be mounted on the board cover 123.

The board case 121 may include a case accommodating portion 121*c* provided to accommodate a cover supporting portion 123*c* of the board cover 123. The case accommodating portion 121*c* may be provided to accommodate the cover supporting portion 123*c* of the board cover 123 while the cover supporting portion 123*c* of the board cover 123 is in a mutually supported state with the upper cap 111.

The separate user interface device 75 may include the board cover 123 provided with the separate input interface 76 and the separate output interface 77. The separate input interface 76 and/or the separate output interface 77 may be provided on the board cover 123. The board cover 123 may be connected to the circuit board 131. The circuit board 131 may be mounted on the board cover 123. The circuit board 131 may be fixed to the board cover 123. The circuit board 131 may be fused to the board cover 123.

The board cover 123 may include the cover fixing portion 123*a* to be fixed to the upper cap 111. In a state in which the cover fixing portion 123*a* is aligned with the cover mounting portion 113 of the upper cap 111, as a fixing member is coupled thereto, so that the board cover 123 may be fixed to the upper cap 111.

The board cover 123 may include the cover coupling portion 123*b* to be coupled with the board case 121. The cover coupling portion 123*b* may be provided to correspond to the case coupling portion 121*b* of the board case 121. For example, the cover coupling portion 123*b* may be elastic and provided in a hook shape, and the case coupling portion 121*b* may be provided in a hole shape.

The board cover 123 may include the cover supporting portion 123*c* provided to be supported by the board case 121. The cover supporting portion 123*c* may be positioned at an end opposite to an end of the board cover 123 at which the cover fixing portion 123*a* is located. The cover supporting portion 123*c* may be supported by the case accommodating portion 121*c* of the board case 121.

The cover supporting portion 123*c* of the board cover 123 is positioned in the case accommodating portion 121*c*, and then in a mutually supported state with the upper cap 111, the cover fixing portion 123*a* and the cover mounting portion 113 are aligned with each other. Then, a fixing member is coupled thereto, so that the separate user interface device 75 may be mounted on the upper cap 111.

The board cover 123 may include a panel seating portion 123*d* on which an inlay panel 125 is seated. The panel seating portion 123*d* may be formed on an upper surface of the board cover 123. The panel seating portion 123*d* may be provided in a groove shape. The panel seating portion 123*d* may be provided to correspond to the inlay panel 125.

The separate user interface device 75 may include the inlay panel 125. The inlay panel 125 may be provided to display the separate input interface 76 and the separate output interface 77 to the user. Patterns corresponding to the separate input interface 76 and the separate output interface 77 may be provided on the inlay panel 125. The inlay panel 125 may include icons for displaying functions of the separate input interface 76.

Referring to FIG. 10 and FIG. 11, the second clothes treating apparatus 60 is provided with the separate user interface device 75 and may include a sensor 141 provided to detect humidity around the second clothes treating apparatus 60.

For example, the second controller 97 may determine a drying course to be performed by the second clothes treating apparatus 60 based on humidity information detected by the sensor 141. For example, the second clothes treating apparatus 60 may include a dehumidifying kit, and the second controller 97 may operate the dehumidifying kit to dehumidify a space in which the second clothes treating apparatus 60 is positioned based on humidity information detected by the sensor 141.

The board cover 123 may include a cover inlet 124 formed to allow moisture to flow into the separate user interface device 75 on which the sensor 141 is positioned. The sensor 141 may detect moisture flowing into the separate user interface device 75 through the cover inlet 124.

The board case 121 may include a cover outlet 122 formed to be inclined downwardly in the direction of gravity so that moisture introduced through the cover inlet 124 is discharged from the separate user interface device 75. The cover outlet 122 may prevent moisture from being stored inside the separate user interface device 75.

Referring to FIG. 12, the integrated user interface device 100 may transmit a control command to the first controller 23 and the second controller 97 based on the user input received through the integrated input interface 106. The separate user interface device 75 may transmit a control command to the second controller 97 based on the user input received through the separate input interface 76.

For example, when the integrated user interface device 100 does not operate due to a failure of the first clothes treating apparatus 10, the user may control the second clothes treating apparatus 60 through the separate user interface device 75.

For example, when the second clothes treating apparatus 60 is separated from the first clothes treating apparatus 10, the user may control the second clothes treating apparatus 60 through the separate user interface device 75.

For example, the second controller 97 may stop the operation of the separate user interface device 75 based on receiving a command input through the integrated input interface 106. For example, the second controller 97 may stop the operation of the separate output interface 77 of the separate user interface device 75 based on receiving a command input through the integrated input interface 106.

Figure 13:
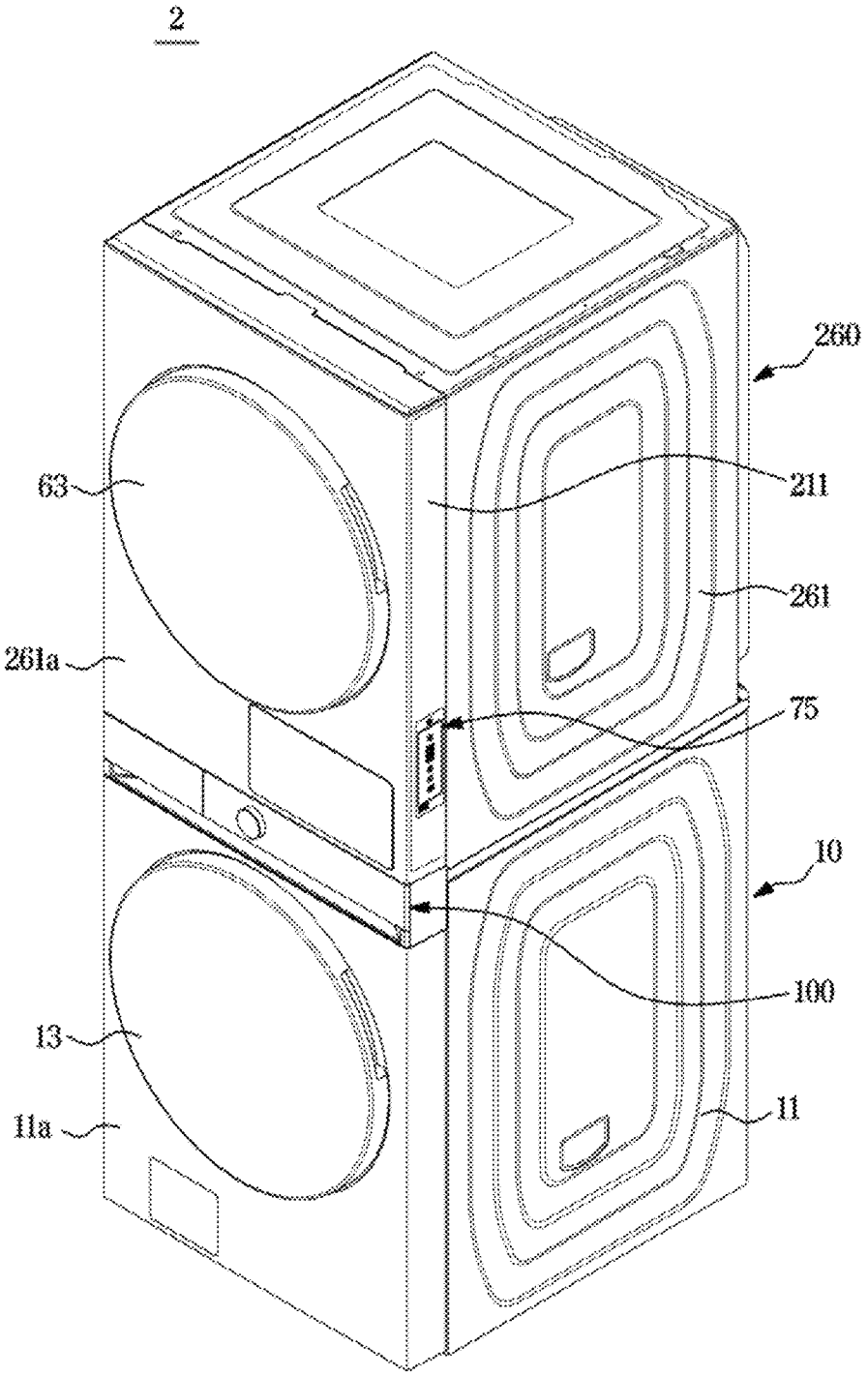
FIG. 13 is a view illustrating a clothes treating system according to an embodiment of the disclosure.

FIG. 13 is a view illustrating a clothes treating system according to an embodiment.

Referring to FIG. 13, a clothes treating system 2 according to an embodiment will be described. In describing the clothes treating system 2 shown in FIG. 13, the same reference numerals are assigned to the same components as those of the clothes treating system 1 shown in FIG. 1, and thus detailed descriptions may be omitted.

Referring to FIG. 13, the clothes treating system 2 according to an embodiment may include the first clothes treating apparatus 10 and a second clothes treating apparatus 260 mountable to the first clothes treating apparatus 10.

The second clothes treating apparatus 260 may include a second housing 261. The second housing 261 may include a second front frame 261*a* and a right cap 211 mountable on a right side of the second front frame 261*a*. The right cap 211 may form a part of a right side surface of the second clothes treating apparatus 260.

The clothes treating system 2 according to an embodiment may include the integrated user interface device 100 provided on the first clothes treating apparatus 10 and the separate user interface device 75 provided on the second clothes treating apparatus 260. The separate user interface device 75 may be mounted on the right cap 211 of the second clothes treating apparatus 260. The separate user interface device 75 may be disposed on the right side surface of the second clothes treating apparatus 260.

Apart from the integrated user interface device 100 capable of controlling the first clothes treating apparatus 10 and the second clothes treating apparatus 260, the clothes treating system 2 according to an embodiment may include the separate user interface device 75 capable of controlling only the second clothes treating apparatus 260, and the separate user interface device 75 may be provided on the right side surface of the second clothes treating apparatus 260. As a result, usability may be improved.

Figure 14:
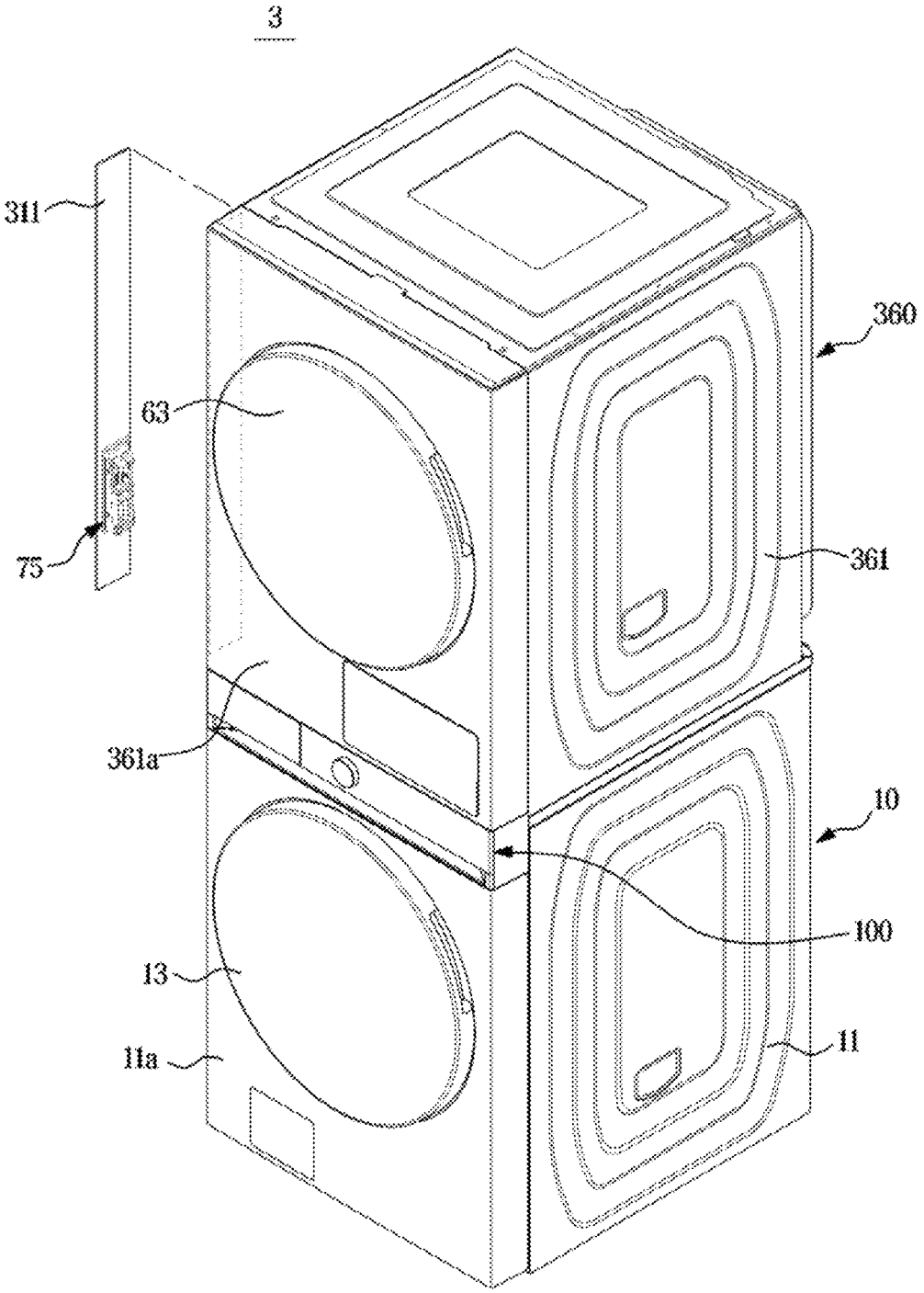
FIG. 14 is a view illustrating a clothes treating system according to an embodiment of the disclosure.

FIG. 14 is a view illustrating a clothes treating system according to an embodiment.

Referring to FIG. 14, a clothes treating system 3 according to an embodiment will be described. In describing the clothes treating system 3 shown in FIG. 14, the same reference numerals are assigned to the same components as those of the clothes treating system 1 shown in FIG. 1, and thus detailed descriptions may be omitted.

Referring to FIG. 14, the clothes treating system 3 according to an embodiment may include the first clothes treating apparatus 10 and a second clothes treating apparatus 360 mountable to the first clothes treating apparatus 10.

The second clothes treating apparatus 360 may include a second housing 361. The second housing 361 may include a second front frame 361*a* and a left cap 311 mountable on a left side of the second front frame 361*a*. The left cap 311 may form a part of a left side surface of the second clothes treating apparatus 260.

The clothes treating system 3 according to an embodiment may include the integrated user interface device 100 provided on the first clothes treating apparatus 10 and the separate user interface device 75 provided on the second clothes treating apparatus 360. The separate user interface device 75 may be mounted on the left cap 311 of the second clothes treating apparatus 360. The separate user interface device 75 may be disposed on the left side surface of the second clothes treating apparatus 360.

Apart from the integrated user interface device 100 capable of controlling the first clothes treating apparatus 10 and the second clothes treating apparatus 360, the clothes treating system 3 according to an embodiment may include the separate user interface device 75 capable of controlling only the second clothes treating apparatus 360, and the separate user interface device 75 may be provided on the right side surface of the second clothes treating apparatus 260. As a result, usability may be improved.

Figure 15:
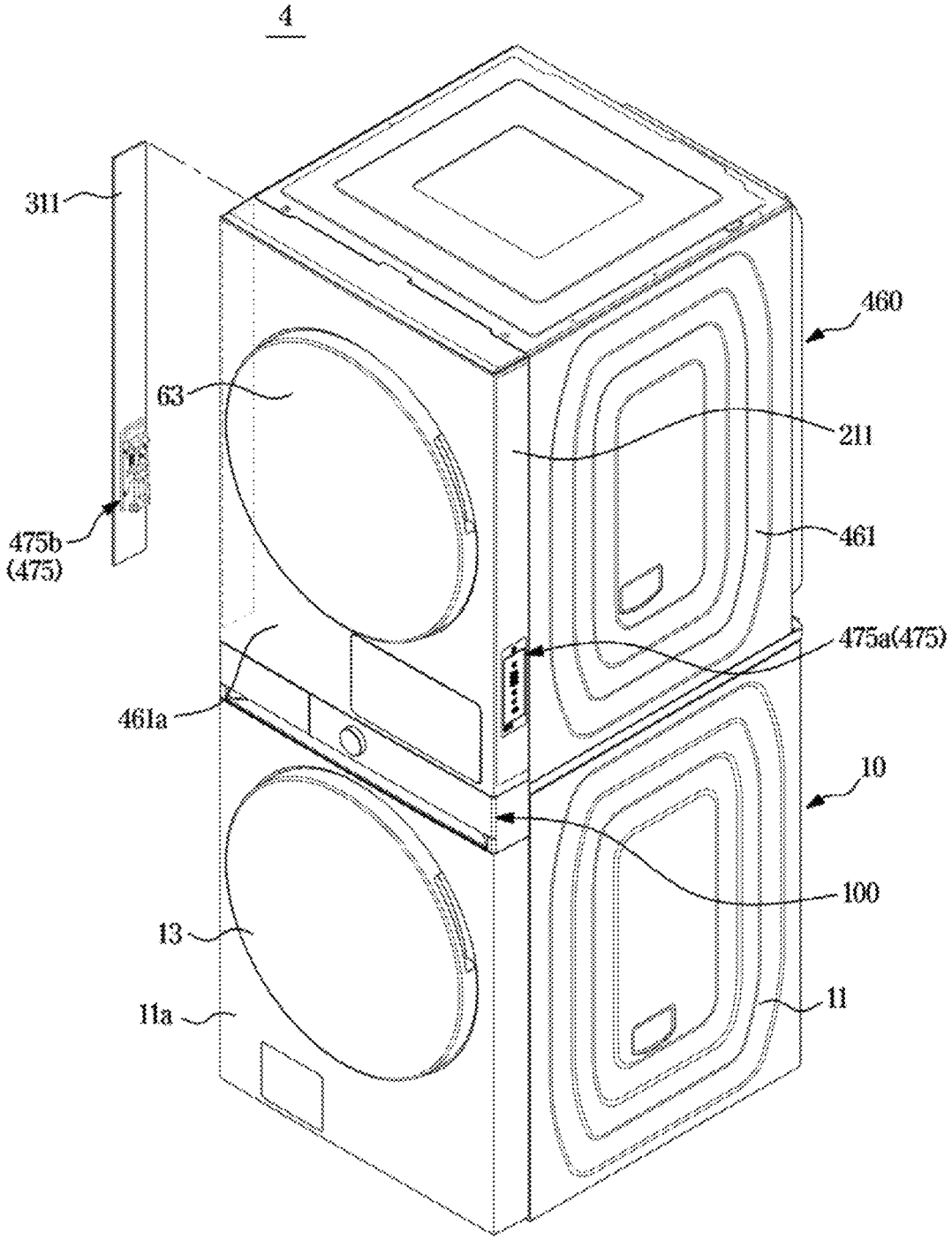
FIG. 15 is a view illustrating a clothes treating system according to an embodiment of the disclosure.

FIG. 15 is a view illustrating a clothes treating system according to an embodiment.

Referring to FIG. 15, a clothes treating system 4 according to an embodiment will be described. In describing the clothes treating system 4 shown in FIG. 15, the same reference numerals are assigned to the same components as those of the clothes treating system 1 shown in FIG. 1, the clothes treating system 2 shown in FIG. 13, and the clothes treating system shown in FIG. 14, and thus detailed descriptions may be omitted.

Referring to FIG. 15, the clothes treating system 4 according to an embodiment may include the first clothes treating apparatus 10 and a second clothes treating apparatus 460 mountable to the first clothes treating apparatus 10.

The second clothes treating apparatus 460 may include a second housing 461. The second housing 461 may include a second front frame 461*a*, the right cap 211 mountable on the right side of the second front frame 461*a*, and the left cap 311 mountable on the left side of the second front frame 461*a*. The right cap 211 may form a part of a right side surface of the second clothes treating apparatus 460. The left cap 311 may form a part of a left side surface of the second clothes treating apparatus 460.

The clothes treating system 4 according to an embodiment may include the integrated user interface device 100 provided on the first clothes treating apparatus 10 and a separate user interface device 475 provided on the second clothes treating apparatus 460.

The separate user interface device 475 may include a first separate user interface device 475*a* and a second separate user interface device 475*b*. The first separate user interface device 475*a* may be mounted on the right cap 211 of the second clothes treating apparatus 460. The second separate user interface device 475*b* may be mounted on the left cap 311 of the second clothes treating apparatus 460. For example, the first separate user interface device 475*a* may have a different configuration to the second separate user interface device 475*b*.

Apart from the integrated user interface device 100 capable of controlling the first clothes treating apparatus 10 and the second clothes treating apparatus 460, the clothes treating system 4 according to an embodiment may include the separate user interface devices 475 capable of controlling only the second clothes treating apparatus 460, and the separate user interface devices 475 may be provided on the right and left side surfaces of the second clothes treating apparatus 260. As a result, usability may be improved.

Figure 16:
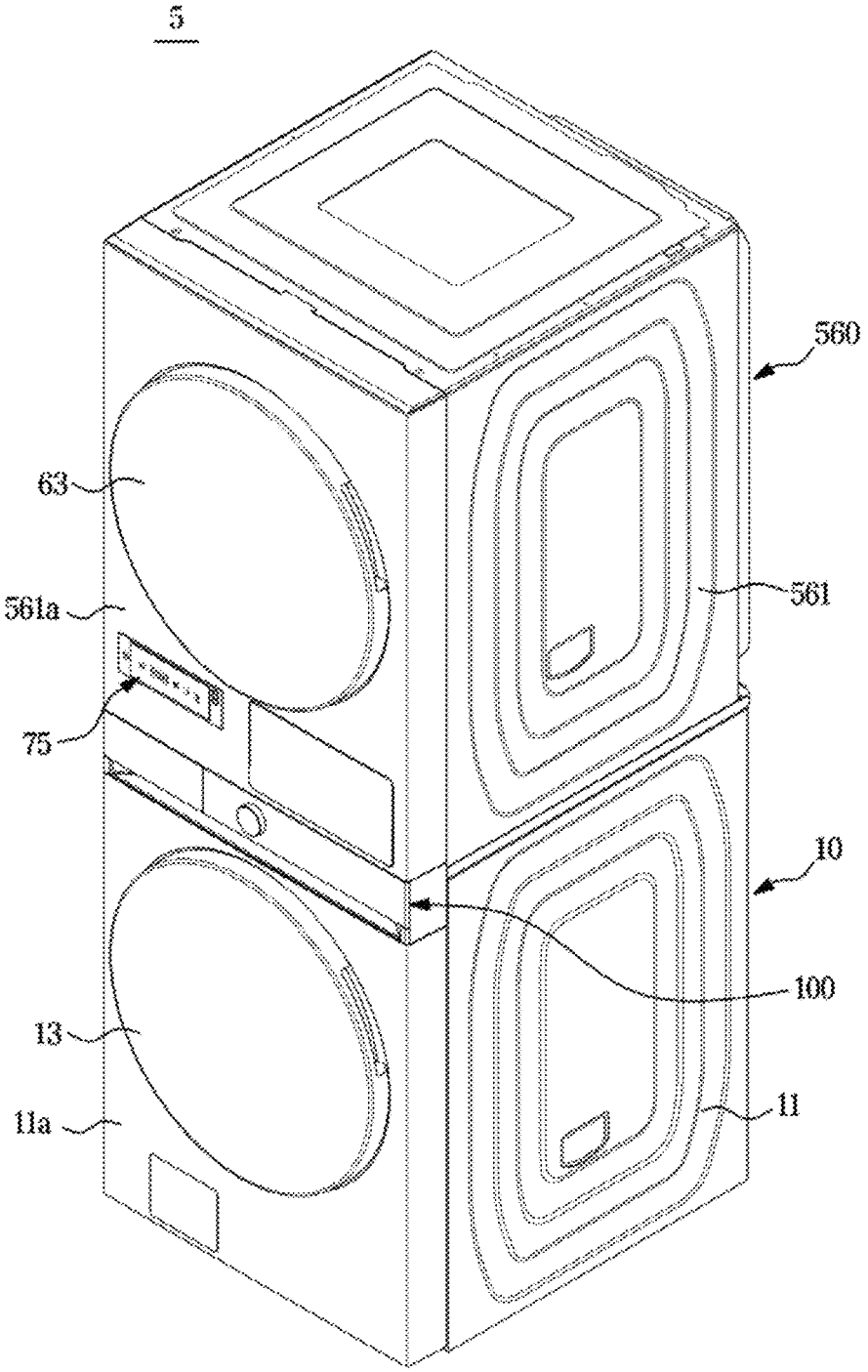
FIG. 16 is a view illustrating a clothes treating system according to an embodiment of the disclosure.

FIG. 16 is a view illustrating a clothes treating system according to an embodiment.

Referring to FIG. 16, a clothes treating system 5 according to an embodiment will be described. In describing the clothes treating system 5 shown in FIG. 16, the same reference numerals are assigned to the same components as those of the clothes treating system 1 shown in FIG. 1, and thus detailed descriptions may be omitted.

Referring to FIG. 16, the clothes treating system 5 according to an embodiment may include the first clothes treating apparatus 10 and a second clothes treating apparatus 560 mountable to the first clothes treating apparatus 10.

The second clothes treating apparatus 560 may include a second housing 561. The second housing 561 may include a second front frame 561*a*.

The clothes treating system 5 according to an embodiment may include the integrated user interface device 100 provided on the first clothes treating apparatus 10 and the separate user interface device 75 provided on the second clothes treating apparatus 560. The separate user interface device 75 may be mounted on the second front frame 561*a* of the second clothes treating apparatus 560. The separate user interface device 75 may be disposed on a front surface of the second clothes treating apparatus 560.

Apart from the integrated user interface device 100 capable of controlling the first clothes treating apparatus 10 and the second clothes treating apparatus 560, the clothes treating system 5 according to an embodiment may include the separate user interface device 75 capable of controlling only the second clothes treating apparatus 560, and the separate user interface device 75 may be provided on the front surface of the second clothes treating apparatus 560. As a result, usability may be improved.

Figure 17:
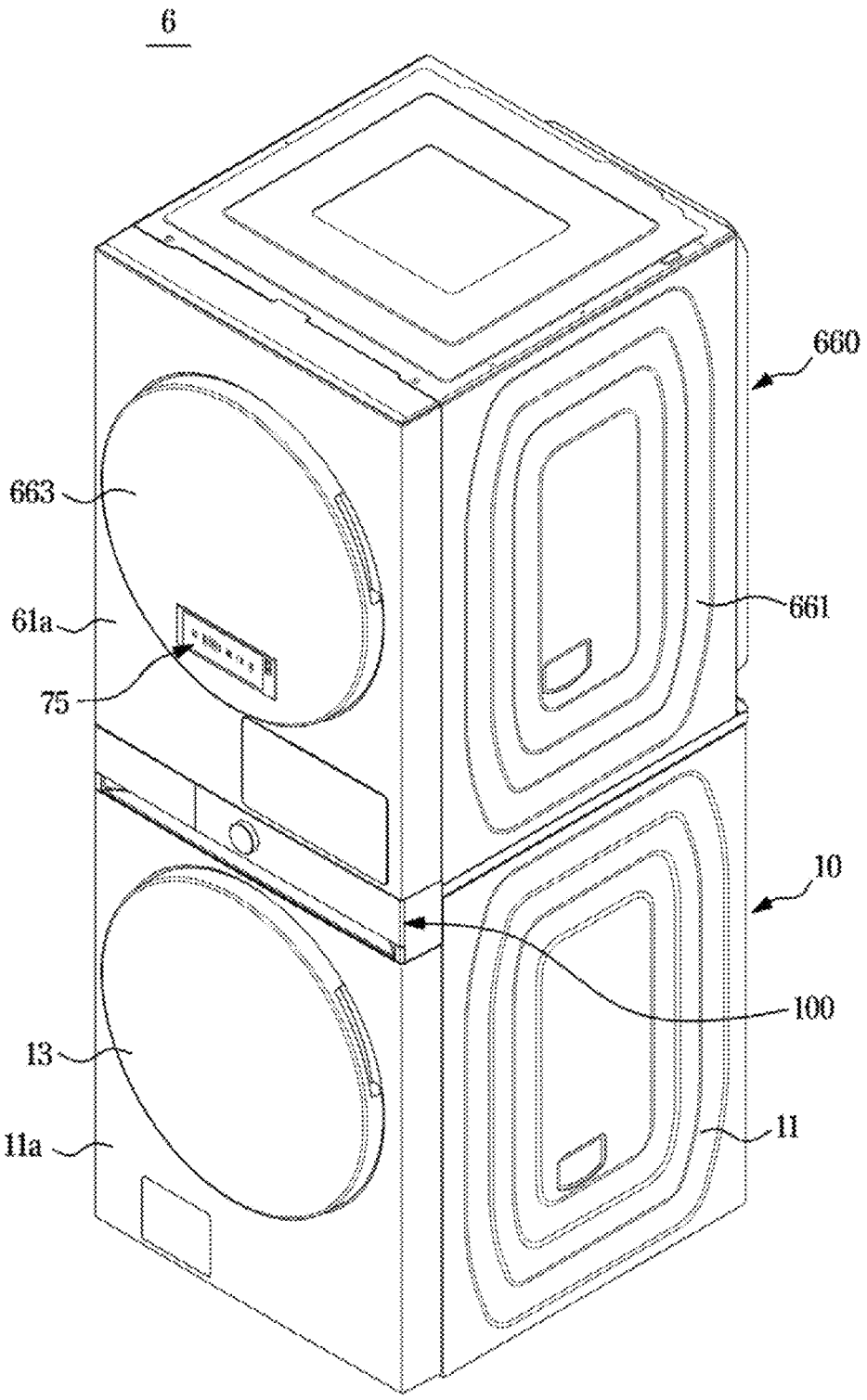
FIG. 17 is a view illustrating a clothes treating system according to an embodiment of the disclosure.

FIG. 17 is a view illustrating a clothes treating system according to an embodiment.

Referring to FIG. 17, a clothes treating system 6 according to an embodiment will be described. In describing the clothes treating system 6 shown in FIG. 17, the same reference numerals are assigned to the same components as those of the clothes treating system 1 shown in FIG. 1, and thus detailed descriptions may be omitted.

Referring to FIG. 17, the clothes treating system 6 according to an embodiment may include the first clothes treating apparatus 10 and a second clothes treating apparatus 660 mountable to the first clothes treating apparatus 10.

The second clothes treating apparatus 660 may include a second housing 661. The second housing 661 may include a second door 663 mounted on the second front frame 61*a*.

The clothes treating system 6 according to an embodiment may include the integrated user interface device 100 provided on the first clothes treating apparatus 10 and the separate user interface device 75 provided on the second clothes treating apparatus 660. The separate user interface device 75 may be mounted on the second door 663 of the second clothes treating apparatus 660. The separate user interface device 75 may be disposed on a front surface of the second clothes treating apparatus 660.

Apart from the integrated user interface device 100 capable of controlling the first clothes treating apparatus 10 and the second clothes treating apparatus 660, the clothes treating system 6 according to an embodiment may include the separate user interface device 75 capable of controlling only the second clothes treating apparatus 660, and the separate user interface device 75 may be provided on the front surface of the second clothes treating apparatus 660. As a result, usability may be improved.

The clothes treating system 1 according to an embodiment may include the first clothes treating apparatus 10 including the first housing 11, the second clothes treating apparatus 60 provided on one side of the first clothes treating apparatus and including the second housing 61, the integrated user interface device 100 mounted on the first housing and controlling the first clothes treating apparatus and the second clothes treating apparatus, and the separate user interface device 75 mounted on the second housing and controlling the second clothes treating apparatus. In the clothes treating system according to an embodiment, the second clothes treating apparatus may be controlled by the separate user interface device when the integrated user interface device does not operate, thereby improving ease of use.

The first clothes treating apparatus may include the first controller 23. The second clothes treating apparatus may include the second controller 97. The integrated user interface device may be connected to the first controller and the second controller. The separate user interface device may be connected to the second controller. In the clothes treating system according to an embodiment, when the integrated user interface device does not operate, a control command may be transmitted to the second controller through the separate user interface device, thereby improving ease of use.

The integrated user interface device may include the integrated input interface 106 receiving the user input, and the integrated output interface 107 displaying visualized information associated with the first and second clothes treating apparatuses. The separate user interface device may include the separate input interface 76 receiving the user input and the separate output interface 77 displaying visualized information associated with the second clothes treating apparatus. The clothes treating system according to an embodiment may individually receive the user input for controlling the second clothes treating apparatus through the separate input interface and individually display a state of the second clothes treating apparatus through the separate output interface.

The separate user interface device may include the board cover 123 mounted on the second housing and including the separate input interface and the separate output interface, the circuit board 131 connected to the board cover, and the board case 121 accommodating the circuit board.

The second housing may include the front frame 61*a* forming the front surface of the second clothes treating apparatus, and the upper cap 111 mounted on the upper portion of the front frame to form a portion of the upper surface of the second clothes treating apparatus, the upper cap on which the board cover is mounted.

The upper cap may include the cap opening 112 formed to mount the separate user interface device. The front frame may include the frame opening 61*b* formed to correspond to the cap opening to mount the separate user interface device.

The front frame may include the reinforcing portion 61*c* formed at a portion where the upper cap is mounted. The clothes treating system according to an embodiment may reinforce strength that may be weakened when the frame opening is formed in the front frame.

The second clothes treating apparatus may include the sensor 141 provided in the separate user interface device to detect humidity.

The board cover may include the cover inlet 124 formed to allow moisture to flow into the separate user interface device on which the sensor is positioned. The board case may include the cover outlet 122 formed to be inclined downwardly in the direction of gravity so that moisture introduced through the cover inlet is discharged from the separate user interface device. The clothes treating system according to an embodiment may prevent moisture from being stored inside the separate user interface device.

The second controller may stop the operation of the separate user interface device based on receiving a command input through the integrated input interface. Upon receipt of the user input through the integrated input interface, the clothes treating system according to an embodiment may stop the operation of the separate user interface device, thereby reducing power consumption.

The integrated user interface device may be disposed on the front surface of the first clothes treating apparatus. The separate user interface device may be disposed on at least one of the upper surface, side surface, or front surface of the second clothes treating apparatus. In the clothes treating system according to an embodiment, the accessibility of the integrated user interface device that is used relatively more often than the separate user interface device that is used relatively less may be improved.

The second clothes treating apparatus may include the second door 663 coupled to the second housing. The separate user interface device may be provided on the second door.

The second clothes treating apparatus may be mounted above the first clothes treating apparatus.

The first clothes treating apparatus may be provided as a washing machine. The second clothes treating apparatus may be provided as a dryer.

The clothes treating apparatus 60 according to an embodiment may include the housing 61 including the front frame 61*a* with the inlet 62 facing forward and the upper cap 111 mounted on the upper portion of the front frame, the door 63 for opening and closing the inlet, and the user interface device 75 provided on the upper surface of the housing. The user interface device may include the board cover 123 mounted on the upper cap and including the input interface 76 and the output interface 77, the circuit board 131 connected to the board cover, and the board case 121 for accommodating the circuit board. Accordingly, the clothes treating apparatus according to an embodiment may improve an assembly structure of the user interface device.

The clothes treating apparatus may further include the sensor 141 provided in the user interface device to detect humidity.

The board cover may include the cover inlet 124 formed to allow moisture to flow into the user interface device on which the sensor is positioned. The board case may include the cover outlet 122 formed to be inclined downwardly in the direction of gravity so that moisture introduced from the cover inlet is discharged from the user interface device. The clothes treating apparatus according to an embodiment may prevent moisture from being stored inside the user interface device.

The upper cap may include the cap opening 112 formed to mount the user interface device. The front frame may include the frame opening 61*b* formed to correspond to the cap opening to mount the user interface device.

The clothes treating apparatus may further include the drum 70 provided within the housing, the heat pump 80 configured to generate hot air to be supplied to the drum, and the controller 97 connected to the user interface device and controlling the drum and the heat pump.

The front frame may include the reinforcing portion 61*c* formed at a portion where the upper cap is mounted. The clothes treating apparatus according to an embodiment may reinforce strength that may be weakened when the frame opening is formed in the front frame.

According to the spirit of the disclosure, the clothes treating system may control the second clothes treating apparatus through the separate user interface device when the integrated user interface device does not operate, thereby improving usability.

According to the spirit of the disclosure, the clothes treating system may transmit a control command to the second controller through separate user interface devices when the integrated user interface device does not operate, thereby improving usability.

Effects obtainable in the present disclosure are not limited to the effects mentioned above, and other effects not mentioned will be clearly understood by those skilled in the art from the description below.

The foregoing has illustrated and described specific embodiments. However, it should be understood by those of skilled in the art that the present disclosure is not limited to the above-described embodiments, and various changes and modifications may be made without departing from the technical idea of the present disclosure described in the following claims.

What is claimed is:

1. A clothes treating system, comprising:

a first clothes treating apparatus including a first housing;

a second clothes treating apparatus including a second housing;

an integrated user interface device mounted on the first housing and configured to control the first clothes treating apparatus and the second clothes treating apparatus; and a separate user interface device mounted on the second housing and configured to control the second clothes treating apparatus, wherein the second housing includes:

a front frame in which an inlet is formed forward and configured to form a front surface of the second clothes treating apparatus, and an upper cap mounted on an upper portion of the front frame to form a portion of an upper surface of the second clothes treating apparatus, the integrated user interface device is disposed on a front surface of the first clothes treating apparatus, and the separate user interface device is disposed on the upper cap so that, when a user enters control input through the separate user interface device, the user enters the control input at the upper surface of the second clothes treating apparatus.

2. The clothes treating system of claim 1, wherein the first clothes treating apparatus includes a first controller, the second clothes treating apparatus includes a second controller, the integrated user interface device is connected to the first controller and the second controller, and the separate user interface device is connected to the second controller.

3. The clothes treating system of claim 2, wherein the integrated user interface device includes:

an integrated input interface configured to receive a user input, and an integrated output interface configured to display integrated visual information associated with the first clothes treating apparatus and the second clothes treating apparatus; and the separate user interface device includes:

a separate input interface configured to receive a user input, and a separate output interface configured to display separate visual information associated with the second clothes treating apparatus.

4. The clothes treating system of claim 3, wherein the separate user interface device includes:

a board cover mounted on the second housing, a circuit board connected to the board cover, and a board case configured to accommodate the circuit board, and the separate input interface and the separate output interface are arranged on the board cover.

5. The clothes treating system of claim 4, wherein the board cover is mounted on the upper cap.

6. The clothes treating system of claim 5, wherein the upper cap includes a cap opening in which to mount the separate user interface device, and the front frame includes a frame opening corresponding to the cap opening.

7. The clothes treating system of claim 5, wherein the front frame includes a reinforcing portion formed at a portion of the front frame on which the upper cap is mounted.

8. The clothes treating system of claim 4, wherein the second clothes treating apparatus includes a sensor in the separate user interface device, the sensor being configured to detect humidity.

9. The clothes treating system of claim 8, wherein the board cover includes a cover inlet configured to allow moisture to flow into the separate user interface device in which the sensor is positioned, and the board case includes a cover outlet configured to be inclined downwardly so that the moisture introduced through the cover inlet is discharged from the separate user interface device.

10. The clothes treating system of claim 3, wherein the second controller is configured to stop an operation of the separate user interface device based on receiving a command input through the integrated input interface.

11. The clothes treating system of claim 1, wherein the second clothes treating apparatus includes a door coupled to the second housing, and the separate user interface device is disposed on the door coupled to the second housing.

12. The clothes treating system of claim 1, wherein the second clothes treating apparatus is mounted above the first clothes treating apparatus.

13. The clothes treating system of claim 1, wherein the first clothes treating apparatus is a washing machine, and the second clothes treating apparatus is a dryer.

14. The clothes treating system of claim 1, wherein the second clothes treating apparatus is configured to be positioned above or below the first clothes treating apparatus.

15. The clothes treating system of claim 1, wherein the second clothes treating apparatus is configured to be positioned at a side of the first clothes treating apparatus.

* * * * *